US012765742B2

(12) United States Patent
Liu et al.

(10) Patent No.: US 12,765,742 B2
(45) Date of Patent: Oct. 20, 2026

(54) MOPPING MODULE AND CLEANING HEAD

(71) Applicant: Beijing Roborock Technology Co., Ltd., Beijing (CN)

(72) Inventors: Jinyi Liu, Beijing (CN); Peng Lei, Beijing (CN); Liang Qiao, Beijing (CN); Xu Li, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 811 days.

(21) Appl. No.: 17/925,330

(22) PCT Filed: Oct. 8, 2021

(86) PCT No.: PCT/CN2021/122633
§ 371 (c)(1),
(2) Date: Nov. 15, 2022

(87) PCT Pub. No.: WO2022/083447
PCT Pub. Date: Apr. 28, 2022

(65) Prior Publication Data

US 2023/0190067 A1 Jun. 22, 2023

(30) Foreign Application Priority Data

Oct. 22, 2020 (CN) ..... 202022370625.0
Oct. 22, 2020 (CN) ..... 202022370628.4
(Continued)

(51) Int. Cl.
*A47L 11/40* (2006.01)
*A47L 9/06* (2006.01)

(52) U.S. Cl.
CPC ..... *A47L 11/4094* (2013.01); *A47L 9/0606* (2013.01); *A47L 9/0673* (2013.01);
(Continued)

(58) Field of Classification Search
None
See application file for complete search history.

(56) References Cited

U.S. PATENT DOCUMENTS 3,064,300 A * 11/1962 Smith ..... A47L 11/30 15/322
6,733,199 B2 * 5/2004 Dingert ..... A47L 13/22 401/1
(Continued)

FOREIGN PATENT DOCUMENTS

CA 2386604 A1 11/2002
CN 202036158 U 11/2011
(Continued)

OTHER PUBLICATIONS

CN-109199259_Translation (Year: 2019).*
(Continued)

*Primary Examiner* — Patrick D Maines
(74) *Attorney, Agent, or Firm* — Calfee, Halter & Griswold LLP

(57) ABSTRACT

A mopping module and a cleaning head. The mopping module includes a water tank, a mopping cloth, and a water volume control mechanism. A water tank hole is provided at a bottom portion of the water tank; the water tank hole communicates with the interior of the water tank; the mopping cloth is provided outside the bottom portion of the water tank; the water volume control mechanism comprises a knob and a water control tray; and by controlling the cooperation between the water control tray and the water tank hole via the knob, the amount of water flowing from the water tank to the mopping cloth through the water tank hole is adjusted.

19 Claims, 8 Drawing Sheets

(30) Foreign Application Priority Data

| | | |
|---|---|---|
| Oct. 22, 2020 | (CN) | 202022370658.5 |
| Oct. 22, 2020 | (CN) | 202022370678.2 |
| Oct. 22, 2020 | (CN) | 202022372627.3 |
| Oct. 22, 2020 | (CN) | 202022372631.X |
| Oct. 22, 2020 | (CN) | 202022372632.4 |
| Oct. 22, 2020 | (CN) | 202022372637.7 |

(52) U.S. Cl.
CPC ..... *A47L 11/4044* (2013.01); *A47L 11/4083* (2013.01); *A47L 11/4088* (2013.01)

(56) References Cited

U.S. PATENT DOCUMENTS

| | | | | |
|---|---|---|---|---|
| 8,997,591 | B1 * | 4/2015 | Vircks | G05G 5/03 200/11 R |
| 10,682,035 | B2 * | 6/2020 | Ji | A47L 11/4088 |
| 11,930,973 | B2 * | 3/2024 | Kim | A47L 11/14 |
| 2008/0178410 | A1 | 7/2008 | Salmon | |
| 2010/0287716 | A1 * | 11/2010 | Kasper | A47L 11/4088 15/4 |
| 2012/0180235 | A1 * | 7/2012 | Libman | A47L 13/50 15/118 |
| 2014/0130289 | A1 * | 5/2014 | Hyun | A47L 11/185 15/319 |
| 2016/0000213 | A1 | 1/2016 | Neumann et al. | |
| 2022/0304542 | A1 * | 9/2022 | Bian | A47L 11/201 |

FOREIGN PATENT DOCUMENTS

| | | | | | |
|---|---|---|---|---|---|
| CN | 202065542 | U | | 12/2011 | |
| CN | 202358952 | U | | 8/2012 | |
| CN | 107072460 | A | | 8/2017 | |
| CN | 207613721 | U | | 7/2018 | |
| CN | 108478127 | A | | 9/2018 | |
| CN | 108553019 | A | | 9/2018 | |
| CN | 108652527 | A | | 10/2018 | |
| CN | 109199259 | A | * | 1/2019 | A47L 11/28 |
| CN | 208892419 | U | | 5/2019 | |
| CN | 209136467 | U | | 7/2019 | |
| CN | 110251006 | A | | 9/2019 | |
| CN | 209770261 | U | | 12/2019 | |
| CN | 209847077 | U | | 12/2019 | |
| CN | 111188910 | A | * | 5/2020 | |
| CN | 210643916 | U | | 6/2020 | |
| CN | 111588310 | A | | 8/2020 | |
| CN | 214017441 | U | | 8/2021 | |
| CN | 214017442 | U | | 8/2021 | |
| EP | 1529478 | A2 | | 5/2005 | |
| KR | 100497622 | B1 | * | 7/2005 | |
| TW | 201707640 | A | | 3/2017 | |

OTHER PUBLICATIONS

CN_111188910_Translation (Year: 2020).*
First Office Action of CN application No. 202011140277.6 dated Nov. 19, 2024.
First Office Action of CN application No. 202011141872.1 dated Nov. 26, 2024.
Partial European Search Report of EP application No. 21881865.6 dated Oct. 15, 2024.
International Search Report and Written Opinion from PCT/CN2021/122633 dated Jan. 6, 2022.
Extended European Search Report of application No. 21881865.6 dated Feb. 25, 2025.

* cited by examiner

A state before the pedal is depressed

A state after the pedal is depressed

MOPPING MODULE AND CLEANING HEAD

CROSS-REFERENCE TO RELATED APPLICATIONS

The present disclosure is a US national phase of a PCT application under PCT/CN2021/122633, filed on Oct. 8, 2021, which claims priority to eight Chinese Patent Applications filed on Oct. 22, 2020, which include: Application No. 202022370625.0 entitled "WATER TANK ASSEMBLY", Application No. 202022372627.3 entitled "WATER TANK ASSEMBLY", Application No. 202022370658.5 entitled "WATER TANK ASSEMBLY", Application No. 202022370628.4 entitled "WATER STOP DEVICE", Application No. 202022372632.4 entitled "MOPPING CLOTH CLEANING DEVICE", Application No. 202022370678.2 entitled "AIRWAY ASSEMBLY AND CLEAN WATER TANK", Application No. 202022372631.X entitled "GROUND CLEANING DEVICE" and Application No. 202022372637.7 entitled "CLEANING HEAD". The entire contents of the PCT application and these eight Chinese patent applications are incorporated herein by reference in their entireties.

TECHNICAL FIELD

The present disclosure relates to the technical field of cleaning tools, and in particular, to a mopping module and a cleaning head including the mopping module.

BACKGROUND

With the continuous development of automated production and productivity, household appliances have been made great progress in terms of electrical appliances and household tools.

However, during the use of a mopping cloth as a household cleaning product, a user usually uses the mopping cloth to actively absorb water, and wipes a ground with the mopping cloth having absorbed water to achieve a cleaning effect. But this manner is too labor-consuming. The user needs to carry the mopping cloth to a place for re-absorbing water and wet the mopping cloth assembly every time the user uses the mopping cloth, which is very inconvenient.

In addition, a vacuum cleaner, among the existing cleaning tools, is an indispensable cleaning product in daily life, which brings great convenience to people's daily life. However, when a vacuum cleaner is used for cleaning, although dust may be effectively absorbed, the ground cannot be completely cleaned, electrostatic dust and small foam particles and other fine debris can be easily missed, resulting in incomplete ground cleaning.

It should be noted that the above information disclosed in the Background section is only for facilitating understanding of the background of the present disclosure, and therefore it may include information that does not constitute the prior art already known to an ordinary skilled person in the art.

SUMMARY

An object of the present disclosure is to overcome the above-mentioned deficiencies of the prior art, and to provide a mopping module and a cleaning head including the mopping module.

According to an aspect of the present disclosure, there is provided a mopping module, including.

a water tank, provided at the bottom thereof with a water tank hole, where the water tank hole is communicated with an interior of the water tank;

a mopping cloth, provided on the outside of the bottom of the water tank; and a water amount control mechanism, including a knob and a water control tray, where the cooperation of the water control tray and the water tank hole may be controlled via the knob to adjust the amount of water flowing from the water tank to the mopping cloth through the water tank hole.

According to another aspect of the present disclosure, there is provided a cleaning head, including.

a mopping module, which is the mopping module according to any of the above; and a vacuum cleaner module, which can be detachably engaged with the mopping module to combine into one piece;

where the vacuum cleaner module is engaged and mounted through a mounting portion provided on the mopping module, and when the vacuum cleaner module and the mopping module are engaged, a bottom surface of the mopping module is in contact with a ground to be cleaned, and a bottom surface of the vacuum cleaner module is separated from the ground to be cleaned.

It is to be understood that the foregoing general description and the following detailed description are only exemplary and explanatory, and do not limit the present disclosure.

BRIEF DESCRIPTION OF THE DRAWINGS

The accompanying drawings here are incorporated in the Description and constitute a part of the Description, show embodiments conforming to the present disclosure, and are used together with the Description to explain the principle of the present disclosure. Apparently, the accompanying drawings in the following description show some embodiments of the present disclosure, and a person of ordinary skill in the art may still derive other drawings from these accompanying drawings without creative efforts.

DETAILED DESCRIPTION

Figure 1:
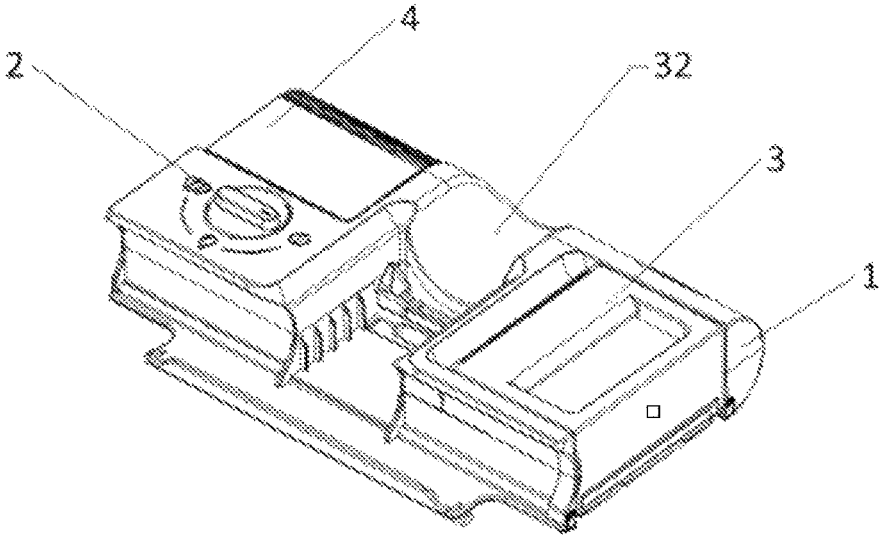
FIG. 1 is a schematic structural diagram of a mopping module according to an embodiment of the present disclosure.

Embodiments will now be described more fully with reference to the accompanying drawings. However, the embodiments can be implemented in various ways and shall not be construed as being limited to the embodiments set forth herein; rather, these embodiments are provided to make the present disclosure full and complete, and fully convey the concept of the embodiments to those skilled in the art. Like reference numerals throughout the drawings denote the same or similar structures, and thus their detailed description will be omitted. Furthermore, the figures are used for schematic illustration of the present disclosure and not necessarily drawn to scale.

Although relative terms such as "upper" and "lower" are used in the Description to describe the relative relationship of one component with respect to another component as shown in the figures, these terms are used in this Description for convenience, for example, based on the exemplary directions shown in the figures. It is to be understood that if an apparatus shown in the figures is turned upside down, the described "upper" component will become a "lower" component. When a structure is "on" another structure, it may mean that the structure is integrally formed on the another structure, or that the structure is "directly" provided on the another structure, or that the structure is "indirectly" provided on the another structure via still another structure.

The terms "a", "an", "the", "said", and "at least one" are used to indicate the presence of one or more elements/components etc. The terms "include" and "have" are used to indicate non-exclusive inclusion and indicate that there may be other elements/components etc. in addition to the listed elements/components etc. The terms "first", "second" and "third" are used as reference, not as a restriction on the number of their subjects.

In the description of the present disclosure, it should be noted that the terms "mounted", "connected with" and "connected" should be understood in a broad sense, unless otherwise expressly specified and limited. For example, it may be a fixed connection or a detachable connection, or an integral connection; it may be a mechanical connection or an electrical connection; it may be directly connected, or indirectly connected through an intermediate medium, and it may be an internal communication between two elements. For those of ordinary skill in the art, the specific meanings of the above terms in the present disclosure may be understood in specific situations.

According to some embodiments of the present disclosure, there is provided a mopping module. As shown in FIG. 1, the mopping module may include a water tank, a mopping cloth and a water amount control mechanism. There is provided a water tank hole at the bottom of the water tank, and the water tank hole communicates with an interior of the water tank. The mopping cloth is provided on the outside of the bottom of the water tank. The water amount control mechanism includes a knob and a water control tray, where by the cooperation of the water control tray and the water tank hole controlled via the knob, the amount of water flowing from the water tank to the mopping cloth through the water tank hole is adjusted.

FIG. 1 to FIG. 12 are schematic diagrams of the mopping module according to embodiments of the present disclosure. As shown in the figures, according to some embodiments of the present disclosure, there is provided a mopping module, including: a water tank 1 with a mopping cloth 18 at the bottom of the water tank; further including: a water amount control mechanism 2, including a knob and a water control tray; a water passing assembly, including a water tank hole 15, a water outlet hole 54, and a water passing channel 53, where, the water tank hole 15 is communicated with an interior of the water tank, the water outlet hole 54 is communicated with the outside for supplying water to the mopping cloth 18, and the water passing channel 53 communicates the water tank hole 15 with the water outlet hole 54; and an air inlet assembly, including an air inlet hole 52 provided at the bottom of the water tank and an air inlet pipeline 51 extending from the air inlet hole 52 toward an upper portion of the water tank.

The knob is connected to the water control tray through a knob rod 23, and the amount of water entering a water control hole 24 of the water control tray from the interior of the water tank through the water tank hole 15 may be controlled by rotating the knob.

The water passing channel 53 is a hollow channel provided at the bottom of the water tank. The water passing channel 53 includes a beginning portion cooperated with the water control tray and an end portion corresponding to the water outlet hole 54, and a curved passage between the beginning portion and the end portion.

When the mopping module is suspended, the air inlet hole 52 is located between the beginning portion and the end portion, and the end portion is higher than the beginning portion.

A water tank bottom-cover 13 is provided between the water tank and the mopping cloth 18, the water passing channel 53 is formed on the surface where the water tank bottom-cover 13 is combined with a bottom surface of the water tank, and the water outlet hole 54 is provided on the water tank bottom-cover 13.

A pedal linkage assembly 4 is configured to control the locking and unlocking of the mopping module and a vacuum cleaner module.

The pedal linkage assembly 4 includes: a pedal assembly and a locking assembly. The pedal assembly includes: a pedal 41, a pedal inner protrusion 46, a rotating shaft 42, and a rotating reset mechanism. The locking assembly includes: a locking shaft 43, a linkage portion 44, a locking portion 45, and a reset mechanism for the locking shaft 43. The pedal inner protrusion 46 interacts with the linkage portion 44 to realize the locking and unlocking of the mopping module and the vacuum cleaner module.

The mopping module further includes a mopping cloth cleaning mechanism 3 which is engaged to the water tank. When the mopping cloth 18 needs to be cleaned, the mopping cloth cleaning mechanism 3 may be disengaged so as to scrape and clean the mopping cloth 18 provided at the bottom of the water tank.

The mopping cloth cleaning mechanism 3 includes a handle 31 and a scraping blade 36. The handle 31 is configured to operate the mopping cloth cleaning mechanism 3 so that the scraping blade 36 can scrape and clean the mopping cloth 18 along a direction of the entire length of the water tank.

An inner diameter of the air inlet pipeline 51 is greater than or equal to a diameter of the air inlet hole 52, and an end of the air inlet pipeline 51 basically abuts against the top of an inner wall of the water tank.

The end of the air inlet pipeline 51 is formed in a zigzag shape, and the top portion of the zigzag shape basically abuts against the top of the inner wall of the water tank.

The air inlet pipeline 51 and the water passing channel 53 are separated from the water in the water tank, and the mopping cloth 18 absorbs water and expands to block the air inlet pipeline 51.

According to some embodiments of the present disclosure, there is provided another mopping module, including: a water tank 1, a water amount control mechanism 2, a mopping cloth cleaning mechanism 3, a pedal linkage assembly 4, and a water stop assembly. The mopping cloth cleaning mechanism 3 is provided on the outside of one end of the water tank 1, the water amount control mechanism 2 and the pedal linkage assembly 4 are symmetrically provided on both sides of an upper portion of another end of the water tank 1. The water stop assembly is communicatively provided within the water tank 1. The water amount control mechanism 2 controls and adjusts the amount of the released water. The mopping cloth cleaning mechanism 3 cleans the water tank 1 in a sliding and contact manner. The pedal linkage assembly 4 is depressed to unlock and release the water tank 1. The water stop assembly automatically closes the water in the water tank 1. The water tank 1 includes a water tank upper-case 11, a water tank lower-case 12, a water tank bottom-cover 13, and a mopping cloth 18. The water tank upper-case 11 and the water tank lower-case 12 are engaged and sealingly connected to form a hollow water tank main body. The water tank bottom-cover 13 is covered and detachably mounted to a lower outer surface of the water tank lower-case 12. The mopping cloth 18 is covered and detachably mounted to a lower surface of the water tank bottom-cover 13.

The water amount control mechanism 2 includes a knob and a water control tray. By the cooperation of the water control tray and the water tank hole 15 controlled via the knob, the amount of water entering into the water passing channel 53 from the water tank through the water tank hole 15 is adjusted. There may be a plurality of water tank holes 15 of different sizes, and the water control tray has a water control hole 24 therethrough, and the water control tray is rotated to control the water control hole 24 to be communicated with the water tank holes 15 of different sizes so as to control the amount of water. Alternatively, there is one water tank hole 15, and the water control tray has a water control hole 24 therethrough, and the water control tray is rotated to adjust an overlapping area between the water tank hole 15 and the water control hole 24 so as to control the amount of water.

In some embodiments, the water amount control mechanism 2 includes a knob upper-cover 21, a knob screw 22, a knob rod 23, and a button spring 27. The knob upper-cover 21, the knob screw 22, and the knob rod 23 are sequentially arranged from top to bottom. The knob upper-cover 21 is provided on an upper surface of the water tank upper-case 11. The knob rod 23 is rotatably penetrated into the water tank lower-case 12. The knob upper-cover 21 and the knob rod 23 are fixedly connected together by the knob screw 22. The knob rod 23 is sleeved with the button spring 27. An upper end and a lower end of the button spring 27 respectively abut against the knob upper-cover 21 and a water tank lower-bracket 14 within the water tank lower-case 12.

An upper outer surface of the water tank upper-case 11 is partially recessed downwardly to form a rotary accommodating groove. A side wall of the rotary accommodating groove is provided with a recessed portion. The knob upper-cover 21 is a rotary body. Steel ball holes are symmetrically provided on both sides of the knob upper-cover 21. A knob steel ball spring 26 and a knob steel ball 25 are sequentially mounted in a steel ball hole from inside to outside. The knob upper-cover 21 is embedded and mounted in the rotary accommodating groove. The knob steel ball 25 abuts against the recessed portion of the side wall of the rotary accommodating groove.

A lower inner surface of the water tank lower-case 12 is integrally provided with an annular columnar water tank lower-bracket 14. A baffle ring is integrally provided in the water tank lower-bracket 14. A bottom case of the water tank lower-case 12 is provided with a plurality of water tank holes 15 therethrough close to the water tank lower-bracket 14. The knob rod 23 has a step-shaped columnar rod body with a smaller-diameter upper portion and a larger-diameter lower portion. An annular water control tray is integrally provided outside a lower end of the knob rod 23. The annular water control tray is provided with a water control hole 24 therethrough. The water control hole 24 cooperates with the water tank hole 15 to regulate the amount of water.

The mopping cloth cleaning mechanism 3 includes a handle 31, a scraping blade 36, and a sliding leg 35. The handle 31 is provided on a first plate body 33. The scraping blade 36 is provided on a second plate body 34. The first plate body 33 and the second plate body 34 intersect with each other to form an L configuration. The handle 31 and the scraping blade 36 are respectively located at the distal ends of the L configuration where the first plate body 33 and the second plate body 34 do not intersect with each other. The sliding leg 35 is located on the second plate body 34. The scraping blade 36 is a rigid rubber strip embedded and mounted at the distal end of the second plate body 34. The scraping blade 36 is made of the same material as that of the second plate body 34, and the scraping blade 36 and the second plate body 34 are integrally formed. The sliding leg 35 is located within a plane where the second plate body 34 is located, and is located at each end of the scraping blade 36 in the length direction.

In some embodiments, the mopping cloth cleaning mechanism 3 includes a handle 31 and a hand-grip groove 32. The handle 31 may be engaged and provided within an upper outer surface of the water tank upper-case 11. The handle 31 may slide along a lower surface of the mopping cloth 18 in a contact manner. The handle 31 is integrally formed into an L shape by the first plate body 33 and the second plate body 34 which are perpendicular to each other.

An accommodating groove for the handle 31 is provided on one side of the upper outer surface of the water tank upper-case 11. The handle 31 may be engaged and arranged in the accommodating groove for the handle 31. The accommodating groove for the handle 31 is open on one side, and the handle 31 is disengaged from the accommodating groove for the handle 31 along the opening direction. The accommodating groove for the handle 31 matches the shape of the first plate body 33 of the handle 31. A sliding chute is provided on both sides of the lower outer surface of the water tank lower-case 12 along the length direction. A sliding leg 35 is provided at each end of one side of the second plate body 34 away from the first plate body 33, and a slidable portion of the sliding leg 35 is provided within the sliding chute.

The pedal linkage assembly 4 is configured to be connected to a brush head of the vacuum cleaner module, and includes a locking shaft 43 and a locking portion 45. The locking portion 45 moves between a first state in which the locking portion 45 locks the brush head and a second state in which the locking portion 45 rotates around the locking shaft 43 so as to unlock the brush head.

The locking portion 45 is provided at one end of the mounting portion, a linkage portion 44 is further provided at the other end of the mounting portion, and the locking portion 45 may be moved from the first state to the second state by the linkage portion 44.

Further, the pedal linkage assembly 4 further includes a pedal 41 provided on an upper surface of the water tank. The pedal 41 is provided with a pedal inner protrusion 46 that interacts with the linkage portion 44, the pedal inner protrusion 46 drives the linkage portion 44 to move through the movement of the pedal 41, so that the locking portion 45 moves from the first state to the second state. The pedal 41 has a rotating shaft 42 and a second reset device, the pedal 41 may move from a third state to a fourth state when depressed, and the second reset device may reset the pedal 41 from the fourth state to the third state; the third state corresponds to the first state, and the fourth state corresponds to the second state. The joint portion of the linkage portion 44 and the pedal inner protrusion 46 is a smooth surface, and limiting protrusions are provided on both ends of the smooth surface. The pedal inner protrusion 46 may slide between the limiting protrusions. A stroke of the pedal inner protrusion 46 sliding between the limiting protrusions is less than or equal to a length of the smooth surface, corresponds to a stroke of the locking portion 45 between the first state and the second state, and also corresponds to a stroke of the pedal 41 between the third state and the fourth state.

In some embodiments, the pedal linkage assembly 4 includes a pedal 41, a rotating shaft 42, a locking shaft 43, a linkage portion 44, a locking portion 45, and a pedal inner protrusion 46. The water tank upper-case 11 and the water tank lower-case 12 are correspondingly provided with a notch for accommodating a linkage device of the pedal 41. The locking shaft 43 is contacted with the pedal 41 through a rigid contact to form a linkage connection, and a moving direction of the pedal 41 is opposite to a locking direction of the locking shaft 43.

The locking shaft 43 is hingedly provided between the water amount control mechanism 2 and the pedal linkage assembly 4. A shaft axis of the locking shaft 43 is parallel to that of the rotating shaft 42. The pedal 41 is hinged onto an upper outer surface of the water tank upper-case 11 through the rotating shaft 42. The locking shaft 43 is hingedly provided on an upper outer surface of the water tank lower-case 12. One end of the locking shaft 43 integrally extends toward the pedal 41 and is provided with a linkage portion 44, and the other end of the locking shaft 43 integrally extends away from the pedal 41 and is provided with a locking portion 45. The included angle between an extending direction of the linkage portion 44 and an extending direction of the locking portion 45 is an obtuse angle.

The water stop assembly includes a static water stop member and/or a suspended water stop member. The static water stop member causes the water tank hole 15 of the water tank to stop discharging water in a static or quasi-static state, and the suspended water stop member causes the water tank hole 15 of the water tank to stop discharging water when suspended. The static water stop member includes an air inlet pipeline 51 and an air inlet hole 52. The air inlet hole 52 is provided on the water tank bottom-cover 13. The air inlet pipeline 51 and the water passing channel 53 are separated from the water in the water tank. The mopping cloth 18 absorbs water and expands to block the air inlet pipeline 51, so that the water passing channel 53 stops the passage of water. The suspended water stop member includes a water outlet hole 54. The water outlet hole 54 is communicated with the water tank hole 15 through the water passing channel 53. A horizontal position where the water outlet hole 54 is suspended is higher than a horizontal position where the water tank hole 15 is suspended. There is at least one water outlet hole 54, which is penetrated through the water tank bottom-cover 13. When the water tank is suspended, the highest point of the water passing channel 53 is higher than each of the one or more water outlet holes 54. The water passing channel 53 has at least two horizontal channels and vertical channels, and the horizontal channels are communicated through the vertical channels. When the water tank is suspended, the water tank hole 15 is located in the horizontal channel which is at the lowest horizontal position, and the plurality of water outlet holes 54 are distributed in the horizontal channels which are at the remaining horizontal positions.

In some embodiments, the water stop assembly includes an air inlet hole 52, a water outlet hole 54, a water passing channel 53, and an air inlet pipeline 51. The water passing channel 53 is formed between the water tank bottom-cover 13 and the water tank lower-case 12. The air inlet pipeline 51 communicates an interior of the water tank main body with the mopping cloth 18. The water tank bottom-cover 13 is provided with at least one water outlet hole 54 therethrough. A plurality of through water tank holes 15 is provided at a position of the lower surface of the water tank lower-case 12 corresponding to the water amount control mechanism. The air inlet hole 52 protrudes from the lower outer surface of the water tank lower-case 12. Both the horizontal position where the air inlet hole 52 is suspended and the horizontal position where the water outlet hole 54 is suspended are higher than the horizontal position where the water tank holes 15 are suspended. The air inlet pipeline 51 is provided within the water tank 1. One end of the air inlet pipeline 51 extends downwardly and non-communicatively passes through the water tank bottom-cover 13 and is in contact with an upper surface of the mopping cloth 18, and the other end of the air inlet pipeline 51 extends upwardly and is not in contact with an upper inner surface of the water tank upper-case 11.

A plurality of through water tank holes 15 is provided at a position of the lower surface of the water tank lower-case 12 corresponding to the water amount control mechanism. The knob rod 23 is rotatably penetrated into the water tank lower-case 12. The knob rod 23 may be rotated through the knob upper-cover 21. An annular water control tray is integrally provided outside a lower end of the knob rod 23. The annular water control tray is provided with a water control hole 24 therethrough. The water control hole 24 cooperates with the water tank holes 15 to communicate or close the water passing channel 53 with the water outlet hole 54.

In one embodiment, there are two water tank holes 15, and the two water tank holes 15 are circumferentially distributed along the water tank lower-bracket 14, and respectively correspond to the two different positions for operating position markers. The two water tank holes 15 have different sectional areas. The recessed portions of the side walls of the rotary accommodating groove are symmetrically provided, and are respectively provided at the positions corresponding to the respective operating position markers, or are provided as spiral grooves.

A sectional area of the water control hole 24 is greater than or equal to that of the second water tank hole. An inner hole of the baffle ring is smaller than an annular inner hole of the water tank lower-bracket 14. An upper end surface of the knob rod 23 has a threaded hole. An upper end of the knob rod 23 passes through the inner hole of the baffle ring in the water tank lower-bracket 14. The knob screw 22 is screwed with the threaded hole of the knob rod 23.

The lower outer surface of the water tank lower-case 12 is partially recessed upwardly to form a water passing groove 16. The water tank bottom-cover 13 is covered detachably and mounted on the lower outer surface of the water tank lower-case 12. A water passing channel is formed between the water tank bottom-cover 13 and the water passing groove 16. The annular water control tray of the knob rod 23 is located within the water passing channel, and the annular water control tray may be rotatable and upwardly and downwardly movable in the water passing channel.

A circular groove is provided under the knob upper-cover 21. An upper end of the button spring 27 abuts against the circular groove under the knob upper-cover 21, and a lower end of the button spring 27 abuts against the baffle ring within the water tank lower-bracket 14. The knob upper-cover 21 and the knob rod 23 move upwardly under the action of a restoring force of the button spring 27.

In some embodiments, in order to achieve the technical purpose of controlling the release of water by the mopping cloth in the embodiment of the present disclosure, the knob rod 23 has a step-shaped columnar rod body, an upper end of the knob rod 23 is a smaller end of the step-shaped columnar rod body, and a lower end thereof is a larger end of the step-shaped columnar rod body; a sectional area of the water control hole 24 is greater than or equal to a sectional area of the second water tank hole, and the upper end of the knob rod 23 passes through the inner hole of the baffle ring within the water tank lower-bracket 14.

The knob upper-cover 21 rotates so that the rigidly fixed knob rod 23 rotates to rotate the annular water control tray at the lower end of the knob rod 23, and so that the water control hole 24 of the annular water control tray moves circumferentially with the rotational movement. The water control hole 24 is not communicated with any of the water tank holes 15 when the knob is at a zero operating position marker; the water control hole 24 is communicated with the first water tank hole when the knob is at a first operating position marker, and the water control hole 24 is communicated with the second water tank hole when the knob is at a second operating position marker.

The knob upper-cover 21, the knob screw 22, and the knob rod 23 are sequentially arranged from top to bottom. The knob upper-cover 21 is rigidly fixed to the knob rod 23 through the knob screw 22. The knob rod 23 is sleeved with a button spring 27. The button spring 27 may be mounted by welding or fitting. An upper end and a lower end of the button spring 27 respectively abut against the knob upper-cover 21 and the water tank lower-bracket 14.

After the knob rotates, the knob rod 23 is under the action of the restoring force of the button spring 27, and an upper surface of the annular water control tray at the lower end of the knob rod 23 quickly and closely contacts a lower surface of the bottom case of the water tank lower-case 12, thereby preventing that the water will leak out from the water tank holes 15 when the water control hole 24 is not communicated with any of the water tank holes 15, and maintaining a good seal.

Meanwhile, when a user implements the embodiment of the present disclosure, after the knob is pressed down, the knob steel ball 25 will disengage from the recessed portion of the side wall of the rotary accommodating groove, and the operating positions of the knob upper-cover 21 will be unlocked. At this point, the knob upper-cover 21 may be arbitrarily rotated to the corresponding operating position, and then the knob is released, the knob upper-cover 21 moves upwardly under the action of the restoring force of the button spring 27; and when the knob upper-cover 21 moves to the recessed portion of the side wall of the rotary accommodating groove, the knob steel ball 25 on the side of the knob upper-cover 21 abuts against the recessed portion of the side wall of the rotary accommodating groove again under the force of the knob steel ball spring 26, so as to automatically lock the operating position of the knob upper-cover 21 again, ensuring that the operating position returns to the correct position when toggled.

Furthermore, a rebound force generated by the knob after rotation will provide the user with a feedback force, which allows the user to feel the tactile change when rotating the operating position, brings a better comfort of rotating operation, and improves the user's experience when using the knob to adjust the amount of water, and meanwhile makes the process of adjusting the amount of water more precise and controllable.

It should be noted that the mopping cloth 18 is connected to the bottom of the water tank lower-case 12. The mopping cloth 18 is configured to clean the ground and is the main body that is acted upon when the water is released, and may be made of a textile. The water is released through the control device to infiltrate the mopping cloth assembly, so as to achieve the technical purpose of infiltrating the mopping cloth assembly at any time for cleaning.

In some embodiments, the knob upper-cover 21 is a rotary body, a circular groove is provided under the knob upper-cover 21, and the knob screw 22 is rigidly embedded in the circular groove. A knob deco 28 is mounted on an upper side of the knob upper-cover 21 to instruct the user to position an operating position marker when rotating the knob upper-cover 21. The knob deco 28 is made of corrosion-resistant hard plastic and is rigidly connected to the knob upper-cover 21. The knob upper-cover 21 is a perfectly circular component, a protrusion is provided along a vertical radius of the center of the knob device, and the knob deco 28 is provided on an upper surface of the protrusion. The knob steel balls 25 and the knob steel ball springs 26 are mounted on both sides of the knob upper-cover 21 by means of abutting against and linkage with the water tank upper-case 11.

In some embodiments, steel ball holes are symmetrically provided on both sides of the knob upper-cover 21. A knob steel ball spring 26 and a knob steel ball 25 are sequentially mounted in a steel ball hole from inside to outside. The knob steel ball spring 26 provides a thrust force towards the outside of the hole, so that the knob steel ball 25 abuts against the recessed portion of the side wall of the rotary accommodating groove, and an axis of the steel ball hole is perpendicular to an axis of the knob screw 22.

The knob steel ball 25 is a rigid spherical body and forms an interference fit with the recessed portion of the side wall of the rotary accommodating groove.

In some embodiments, a water tank Velcro 17 is mounted on a lower side of the water tank bottom-cover 13. The water tank Velcro 17 is connected to the water tank bottom-cover 13 by bonding. The mopping cloth 18 and the water tank bottom-cover 13 are detachably connected through the water tank Velcro 17. In order to facilitate the user to mount the mopping cloth of the mopping module, the water tank Velcro 17 is bonded at the bottom of the water tank by solid glue, and the mopping cloth of the mopping module is affixed or removed through the water tank Velcro 17.

When the handle 31 is engaged within the upper outer surface of the water tank upper-case 11, a plane where the first plate body 33 is located is parallel to a plane where the water tank upper-case 11 is located, and a plane where the second plate body 34 is located is parallel to the plane where the water tank upper-case 11 is located.

When the handle 31 slides along the lower surface of the mopping cloth 18 in a contact manner, the distance between a side of the second plate body 34 in contact with the lower surface of the mopping cloth 18 and the mopping cloth 18 is variable.

The side of the second plate body 34 in contact with the lower surface of the mopping cloth 18 is machined with several concave-convex stripes for increasing a sliding friction force of the second plate body 34 and improving the effect of scraping and cleaning the mopping cloth.

The handle 31 may rotate around the sliding leg 35 of the first plate body 33. During the rotating operation, the handle 31 disengages from the accommodating groove for the handle 31 and rotates to a side of the lower outer surface of the water tank lower-case 12.

A scraping blade 36 is provided at one end of the sliding leg 35 away from the second plate body 34. The second plate body 34 may move toward the mopping cloth 18 by means of compressing the scraping blade 36 by the sliding leg 35, so that surface contact may be achieved for different types of mopping cloth; and during the dehydration process of the mopping cloth, the size of the mopping cloth will also be reduced. The distance between the side of the second plate body 34 in contact with the lower surface of the mopping cloth 18 and the mopping cloth 18 may be dynamically adjusted by the scraping blade 36 to achieve repeated dehydration of the mopping cloth.

The sliding leg 35 of the second plate body 34 may slide back and forth along a penetrating direction of the sliding chute 19. In order to prevent the handle 31 from disengaging from the water tank main body, a stop rubber plug is provided at one end of the sliding chute 19 away from the accommodating groove for the handle 31. The stop rubber plug has a rectangular parallelepiped shape, and one side of the stop rubber plug is fixedly adhered into the sliding chute 19 to prevent the sliding leg 35 of the handle 31 from sliding out of the sliding chute 19.

The hand-grip groove 32 is provided on one side of the water tank upper-case 11 for grasping the mopping cloth assembly more firmly by the user. The above-mentioned hand-grip groove 32 may be machined to be recessed downwardly or to be annular handle-shaped, and the specific machining mode is not limited here, as long as it is ensured that the purpose of the hand-grip groove 32 is to grasp more firmly, for grasping the water tank main body.

The hand-grip groove 32 may be a groove-type component made of the same material as that of a functional panel, which is connected to the water tank by gluing or snap-fitting. When the user needs to clean the mopping cloth, it is necessary to firmly hold the entire mopping module by hand, and at this point, the user may grasp the groove portion by hand based on the setting of the hand-grip groove 32, so as to achieve the technical effect of firmly grasping the mopping module.

Preferably, the hand-grip groove 32 is integrally formed in the middle of the upper outer surface of the water tank upper-case 11, and an arc-shaped recessed portion of the hand-grip groove 32 is embedded on the functional panel on the front of the mopping cloth.

The mopping cloth may be made of a common textile used for cleaning the ground, and is fixed in a case by a fixing device, so that when the user uses the mopping cloth assembly to clean the ground, the mopping cloth assembly may clean the dust or garbage on the ground.

The case may be made of metal or environmentally friendly hard plastic material, and the mopping cloth assembly is fixed in the case by the fixing device to form an integral mopping device.

The handle 31 may be a pull-rod drawable handle 31 made of environmentally friendly hard plastic, which is usually retracted into the water tank when not in use, and the handle 31 needs to be drawn out when the user needs to use the handle 31 for cleaning the mopping cloth, so that the handle 31 may be operated so as to achieve the technical effect of cleaning the mopping cloth.

In some embodiments, in order to clean the mopping cloth of the mopping module by the handle 31, the handle 31 may be designed to be drawable, that is, a drawable component is provided on the handle 31 for pulling the handle 31 out of the mopping cloth. The user may pull out and retract the handle 31 by pulling or pushing hard after grasping the handle 31.

In some embodiments, in the embodiment of the present disclosure, after pulling or pushing the handle 31, the user needs to rotate the handle 31 to make the handle 31 be in a working state. The mopping cloth may be cleaned when the handle 31 is in the working state, and the handle 31 is in a state in which the user may use the handle 31. In this state, the user only needs to operate the handle 31 according to the following method to achieve the technical purpose of quickly cleaning the mopping cloth.

In some embodiments, after rotating the handle 31, the user may slide the handle 31 along the penetrating direction of the sliding chute 19 of the water tank lower-case 12. The user needs to hold a grip of the handle 31 and slide the handle 31 back and forth along an arrangement direction of the sliding chute 19. The technical effect of fully cleaning the mopping cloth may be achieved by squeezing the mopping cloth body in the water tank back and forth. The mopping cloth in the mopping module may be made of a textile with a certain toughness.

In some embodiments, in order to avoid unnecessary over-force damage or to avoid to slide out of the sliding chute 19 when the user uses the handle 31 to slide along the sliding chute 19, a stop rubber plug is provided on one side of the sliding chute 19 for being forced to soft-stop when the handle 31 is slid to a certain position by the user, so as to inform the user that this position is a limit position and it is not suitable to continue to push the handle 31 hard.

During the use of the embodiment of the present disclosure, the mopping cloth cleaning device is taken out of the water tank by one hand, and the hand-grip groove 32 of the mopping cloth cleaning device is held by the other hand. The mopping cloth is located on the underside of the water tank lower-case 12, and with turning the handle 31 over by 180°, the handle 31 moves back and forth along the sliding chute 19 of the water tank. The handle 31 is designed with a scraping blade 36 for maintaining a surface contact. The second plate body 34 may be moved toward the mopping cloth 18 by means of compressing the scraping blade 36 by the sliding leg 35, thereby dynamically adjusting the distance between the side of the second plate body 34 in contact with the lower surface of the mopping cloth 18 and the mopping cloth 18 for different types of mopping cloth, so that the mopping cloth may be fully dehydrated, thereby achieving the function of cleaning the mopping cloth without hands.

In addition, in order to control the positive movement of the handle 31 along the track, a stop rubber plug is provided within the sliding chute 19.

The included angle between an extending direction of the linkage portion 44 and an extending direction of the locking portion 45 is θ, where $90° \leq \theta < 180°$.

Preferably, the included angle between the extending direction of the linkage portion 44 and the extending direction of the locking portion 45 is $120° < \theta < 150°$.

A pedal inner protrusion 46 is integrally extended from a lower surface of the pedal 41. The surface of the linkage portion 44 of the locking shaft 43 facing the pedal 41 is provided with two limiting protrusions. The pedal inner protrusion 46 cooperates with the two limiting protrusions to limit a depressed position and a reset position of the pedal 41.

The surface of the locking portion 45 of the locking shaft 43 away from the pedal 41 is provided with a locking protrusion. A connecting rod of the mopping module has a locking groove, and the locking protrusion may be inserted into the locking groove to fix the mopping module to the connecting rod.

An extended end of the locking portion 45 is tapered, which is convenient for guiding the locking protrusion of the locking portion 45 to be inserted into the locking groove of the connecting rod of the mopping module.

A hinged portion between the rotating shaft 42 and the water tank upper-case 11 is sleeved with an upper reset spring, and the upper reset spring provides a restoring force to make the pedal 41 go upward. A hinged portion between the locking shaft 43 and the water tank lower-case 12 is sleeved with a lower reset spring, and the lower reset spring provides a restoring force to make the linkage portion 44 of the locking shaft 43 go upward and make the locking portion 45 go downward.

The pedal 41 is provided with anti-sliding grooves which are arranged laterally. The anti-sliding grooves are arranged in a manner of arithmetic progression on the upper surface of the pedal 41.

In some embodiments, the pedal 41 of the pedal linkage device according to the embodiment of the present disclosure is used to provide a position to be depressed for the user. The user may unlock the mopping module by depressing the pedal 41, which is convenient for the user to remove and mount the mopping module. The locking shaft 43 and the rotating shaft 42 may be made of wear-resistant metal material, and are used to displace and lock the pedal 41 when the user uses the pedal 41.

Both sides of the rotating shaft 42 are machined with concave positioning grooves respectively, and a torsion spring for the rotating shaft 42 is mounted on the concave positioning groove for performing a return operation when the rotating shaft 42 twists.

Both sides of the locking shaft 43 are machined with concave positioning grooves respectively, and a torsion spring for the locking shaft 43 is mounted on the concave positioning groove for performing a return operation when the locking shaft 43 twists.

When the user depresses the pedal, the pedal 41 drives the rotating shaft 42 to rotate, and then in order to return the pedal 41, it is necessary to mount the torsion spring for the rotating shaft 42 on the rotating shaft 42, and the function of the torsion spring may be to automatically return the pedal by generating a reverse torque.

An upper side surface of the locking shaft 43 is in contact with a rigid protruding portion of the lower surface of the pedal 41 for linkage with the pedal 41. The protruding portion is a triangular protrusion, and an apex thereof serves as a contact point for contacting the limiting protrusion of the locking shaft 43. The rigid protrusion on the lower surface of the pedal 41 is the pedal inner protrusion 46, which cooperates with the two limiting protrusions to limit a depressed position and a reset position of the pedal 41.

In some embodiments, in order to achieve the disengaging and unlocking of the locking shaft 43 when the user depresses the pedal 41, a protrusion is provided under the pedal 41, and the protrusion is rigidly connected to the pedal 41 itself, and is fixed on the mopping module through the case. The protrusion is in contact with the locking shaft 43, that is, when the protruding portion of the pedal 41 rotates under the external force of the pedal 41, the locking shaft 43 will be driven to rotate at the same time, so as to unlock the mopping module timely responding to the user's depressing.

In some embodiments, in order to avoid unsuccessful depressing of the user due to too small friction force when using the pedal 41, an anti-sliding groove is provided on the upper side of the pedal 41, that is, at a position where the user depresses the pedal 41, in some embodiments of the present disclosure. There may be several anti-sliding grooves, and thus the number of anti-sliding grooves is not limited here as long as the anti-sliding effect may be achieved.

In addition, at the time of implementing the embodiment of the present disclosure, when the user depresses the pedal 41 of the mopping module with the tiptoe, the pedal 41 moves downwardly, and the locking shaft 43 is driven to rotate counterclockwise. The locking shaft 43 is fixedly connected with the connecting rod of the mopping module by the protrusion of the locking portion 45. When the locking shaft 43 rotates counterclockwise, the mopping module disengages from the connecting rod, and otherwise the mopping module engages with the connecting rod more closely. A reset torsion spring is assembled on the locking shaft 43 and the rotating shaft 42 to facilitate the reset of the pedal 41 and the locking shaft 43.

In addition, for the entire mopping module, the embodiments of the present disclosure can realize the replacement and removal of the water tank 1 by depressing the pedal 41 in the process of using the mopping module by the user, without manual disengaging operation, which increases the convenience and operability for the user.

An air inlet hole 52 is provided on the lower extending end surface of the air inlet pipeline 51. The air inlet pipeline 51 is annular cylindrical. One end of the air inlet pipeline 51 extends downwardly and protrudes from the lower surface of the water tank lower-case 12, and the other end of the air inlet pipeline 51 extends upwardly and protrudes into the interior of the water tank upper-case 11.

An upwardly recessed portion is provided at a position of the water tank upper-case 11 corresponding to the air inlet pipeline 51. An upper extending end at the other end of the air inlet pipeline 51 is inserted with a clearance fit into the recessed portion. An upper extending end surface of the other end of the air inlet pipeline 51 is not in contact with a bottom surface of the recessed portion of the water tank upper-case 11.

A distance of less than 1 mm is maintained between the upper extending end surface of the other end of the air inlet pipeline 51 and the bottom surface of the recessed portion of the water tank upper-case 11.

A distance of 0.5 mm is maintained between the upper extending end surface of the other end of the air inlet pipeline 51 and the bottom surface of the recessed portion of the water tank upper-case 11.

The upper extending end surface of the other end of the air inlet pipeline 51 is provided with an opening groove 55. The opening groove 55 has a depth smaller than a depth of the recessed portion, and is used to increase the area for the air entering into the water tank main body, and meanwhile to prevent impurities in the water in the water tank main body from blocking the air inlet pipeline 51 or to prevent the air inlet holes from forming a water film. The opening groove 55 may be cross-shaped or may be provided in the form of symmetrical notches, or may be provided in a saw teeth shape, which will not be described in detail here.

The water passing channel 53 is provided in the edge of the lower surface of the water tank lower-case 12. The water passing channel 53 may be arranged as a main path in an equidistant offset corresponding to the shape of the edge of the lower surface of the water tank lower-case 12, or may be further arranged as a plurality of main paths in an equidistant offset inwardly, and the plurality of main paths are connected by branch paths.

The water tank bottom-cover 13 is provided with at least one water outlet hole 54 therethrough, and the water passing groove is communicated with the water outlet hole 54 through the water passing channel 53, and the water passing channel 53 has a horizontal main path and a vertical branch path.

The water outlet holes 54 are evenly distributed along a horizontal main path of the water passing channel 53. The air inlet holes 52 are evenly distributed along another horizontal main path of the water passing channel 53. Alternatively, the air inlet holes 52 and the water outlet holes 54 are located at the same horizontal position along the horizontal main paths of the water passing channel 53.

The air inlet hole 52 non-communicatively extends through the water tank bottom-cover 13 and is in contact with the upper surface of the mopping cloth 18, and the air inlet hole 52 is communicated with the air inlet pipeline 51.

A plurality of air inlet holes 52 is communicated with the air inlet pipeline 51 through a triangular sectional channel, or the plurality of air inlet holes 52 is communicated with the air inlet pipeline 51 respectively.

The lower outer surface of the water tank lower-case 12 is partially recessed upwardly to form a water passing groove, and the position of the water tank bottom-cover 13 corresponding to the water passing groove is recessed downwardly to form a bottom-cover water passing groove, so as to increase a sectional area of the water passing channel 53 to improve a discharge amount of water.

A plurality of through water tank holes 15 is provided at a position of the lower surface of the water tank lower-case 12 corresponding to the water amount control mechanism. The water outlet hole 54 may be communicated with the water tank holes 15 through the water passing channel 53, so that the water in the water tank main body may be discharged to the mopping cloth 18.

The mopping cloth 18 is made of a textile which readily absorbs water. A bottom end of the air inlet hole 52 is closely attached to the water absorbent textile of the mopping cloth 18, and the water absorbent textile expands after absorbing water and closes the air inlet hole 52.

In some embodiments, when using the embodiments of the present disclosure, the user needs to lay the mopping module flat, so that when the mopping module is laid flat, the water in a water tank body will not overflow to cause pollution. The water tank body is provided to store water for cleaning needed for the mopping cloth in the mopping module. And, an air inlet hole 52 of the water tank is provided to communicate an air pressure in the water tank body with an external atmospheric pressure, so that when the internal pressure is equal to the external pressure, the water in the water tank body automatically sinks into and infiltrates the mopping cloth of the mopping module only under the action of gravity. Therefore, when the air inlet hole 52 of the water tank is blocked by the wet mopping cloth, the air inlet hole 52 of the water tank cannot obtain the external atmospheric pressure, and thus the water in the water tank will not drop to the mopping cloth of the mopping module under the action of gravity, and the space in the water tank body will further be in a relatively vacuum state.

In some embodiments, an upper portion of the water tank body is provided with a circular recessed portion, and the circular recessed portion is in clearance fit with an air inlet channel of the water tank to form an upper communication structure, for inputting the air introduced through the air inlet hole 52 of the water tank into the water tank body through the air inlet channel.

In some embodiments, the above-mentioned water tank body is configured to accommodate water for cleaning. The air inlet hole 52 of the water tank, as a key mechanism for determining whether the water for cleaning stops sinking into the mopping cloth of the mopping module, needs to form the upper communication structure with the air inlet hole 52 of the water tank. The upper communication structure may be a gap of not more than 1 mm, which is integrally recessed and formed during preparation of the water tank body, for avoiding damage to the mopping module when cleaning the ground. The gap between the air inlet hole 52 of the water tank and the water tank body of the upper communication structure is used to input the air introduced through the air inlet hole 52 of the water tank into the water tank body.

In order to enable the air introduced through the air inlet hole 52 to flow to the water tank body through an air passage, a gap of 1 mm from a top wall of the water tank body is provided. The gap is a communication passage for circulating the air in the air passage and in the water tank body, so that the internal and external air pressures are the same.

In some embodiments, a rubber sealing ring having the same outer diameter as the air inlet hole 52 of the water tank is mounted at the bottom of the air inlet hole 52 of the water tank to prevent outside air from entering into the air inlet hole 52 of the water tank when the air is closed.

In some embodiments, in order to make the air inlet hole 52 of the water tank reach a sealed state except for the influence of the mopping cloth of the mopping module when the air enters and exits, a rubber sealing ring may be mounted at the bottom end of the air inlet hole 52 of the water tank, and the rubber sealing ring may be bonded and connected to the bottom end of the air inlet hole 52 of the water tank, for preventing the outside air from entering into the air inlet hole 52 of the water tank to result in incomplete water stoppage after the air is closed when the mopping cloth of the mopping module is wet.

In some embodiments, the air inlet hole 52 of the water tank and the mopping cloth of the mopping module are in contact with each other.

In some embodiments, the mopping cloth of the mopping module may be made of a textile which readily absorbs water, and the bottom of the water tank body is bonded and connected to the mopping cloth of the mopping module through a Velcro. Based on the above connection means, the position of the air inlet hole 52 of the water tank where air enters, that is, the bottom end of the air inlet hole 52 of the water tank, forms a close attachment relationship with the above-mentioned mopping cloth of the mopping module made of the water absorbent textile, and then when the water absorbent textile expands after absorbing water, the position of the air inlet hole 52 of the water tank where air enters is closed, so to achieve the technical effect of water stoppage.

In addition, according to an implementation method of the embodiments of the present disclosure, when a knob switch of the water amount control module is in a large water operating position or in a small water operating position, the add-on type mopping module is still and laid flat on the ground, and thus the prerequisite is that the mopping module is still and laid flat. In the event that the user forgets to turn off the knob, the water outlet hole 54 will continuously discharge water, and if the water tank discharges water, air needs to be provided from the outside to ensure that the air pressure of the water tank is the consistent with the external air pressure. When the water discharged from the water tank is large enough and wets the mopping cloth, the water in the mopping cloth will naturally close and seal the air inlet hole 52, so that the water tank cannot be supplied with air pressure difference, and thus the water tank body stops discharging water in a certain period of time. Therefore, the water stop function is realized when the add-on type mopping module is laid flat. In addition, according to the water shrinkage and water absorption of the mopping cloth, it is ensured that the water will not overflow onto the periphery of the mopping cloth during discharge of water from the water tank body, and it will not cause ground pollution.

In addition, when the mopping module is not used, the user may block the water outlet hole 54 when hanging the mopping cloth through the function of the horizontal water stoppage and the air inlet hole, so as to limit the continuous outflow of water in the water tank.

In some embodiments, at least one air inlet hole is protruded from the lower outer surface of the water tank lower-case 12. The air inlet hole extends non-communicatively through the water tank bottom-cover 13 and is in contact with the upper surface of the mopping cloth 18. The air inlet hole is communicated with the air inlet pipeline 51. The air inlet holes and the air inlet pipeline 51 are connected either by a triangular section channel communicated by a plurality of air inlet holes, or by communicating the air inlet holes with the air inlet pipeline 51 respectively, which will not be described in further detail here.

The air inlet holes 52 are used to suck in and close the air through the water tank. Therefore, the air inlet holes 52 control whether the water in the water tank may reach the mopping cloth of the mopping module, and thus the evenly distributed air inlet holes 52 may accurately acquire a wetness of the mopping cloth. That is, only after all of the air inlet holes 52 are closed, the outside air will not enter into the air inlet holes 52 of the water tank, so as to form a relatively vacuum environment in the water tank body, so that the water in the water tank will not overflow due to the suspension of the group mopping module.

In order to determine the dryness or wetness of the mopping cloth of the mopping module more accurately through the air inlet holes, there may be provided a plurality of air inlet holes, and meanwhile the plurality of air inlet holes is evenly distributed at the bottom of the water tank body. After the mopping cloth is bonded at the bottom of the water tank body, all of the air inlet holes will be closed and open based on the dryness or wetness of the mopping cloth. Therefore, only when the mopping cloth is completely wet, it is possible that all the air inlet holes are closed so that the space in the water tank body is in a relatively vacuum state, and the water in the water tank body will not overflow onto the mopping cloth, so as to achieve a better effect of water stoppage.

A plurality of through water tank holes 15 is provided at a position of the lower surface of the water tank lower-case 12 corresponding to the water amount control mechanism. The water outlet holes 54 are evenly distributed along a horizontal main path of the water passing channel 53; the air inlet holes are evenly distributed along another horizontal main path of the water passing channel 53, or the air inlet holes and the water outlet holes 54 are located at the same horizontal position along the horizontal main paths of the water passing channel 53. The horizontal positions of both the air inlet holes and the water outlet holes 54 are higher than a horizontal position of the water tank holes 15 of the water tank lower-case 12.

In addition, in the process of using the embodiments of the present disclosure, when the add-on type mopping module is in a suspended state, no matter whether a water amount control knob of the water tank is in the large water operating position or in the small water operating position, the water will not flow out from the water outlet hole 54 of the water passing channel 53. The position of the water tank hole 15 is lower than the position of the water outlet hole 54. Due to the action of gravity, the water will not flow upwardly to the water outlet hole 54 during suspension of the mopping module. Meanwhile, due to the action of the wet mopping cloth, the air in the water tank body is closed, so as to achieve the effect of water stoppage.

In addition, during the process of suspending the mopping module, the amount of water in the water tank of the mopping module is controlled by the action of the mopping cloth and the air inlet hole 52, so that the air inlet hole 52 may be blocked when the user suspends the mopping cloth, so as to limit continuous outflow of the water in the water tank, and meanwhile, when the mopping cloth is short of water, the mopping cloth is infiltrated with a structure such as the water outlet hole 54, so as to achieve the technical effect that the ground may be cleaned at any time.

In some embodiments, the water outlet holes 54 are evenly distributed in arithmetic progression on one side of the mopping module, a hole site of each of the water outlet holes 54 is a perfect circle, and a center-to-center distance of each two adjacent water outlet holes 54 is 1 cm.

In some embodiments, the air inlet holes 52 are evenly distributed in arithmetic progression on the other side of the mopping module, a hole site of each of the air inlet holes 52 is a perfect circle, and a center-to-center distance of each two adjacent water outlet holes 54 is 1 cm.

In some embodiments, with respect to the embodiments of the present disclosure, in order to achieve the purpose of transmitting and closing the air pressure to the water tank body, the air exhaust pipeline is communicated with the water tank body, and the air inlet hole is located between the mopping cloth and the bottom of the water tank body for directly contacting the mopping cloth and sucking in or closing the air based on the dryness or wetness of the mopping cloth, and then the air passing through the air inlet hole and the air inlet pipeline 51 may also pass through the communication passage to the water tank body. When the air inlet hole may suck in air, the air pressure in the water tank body is the same as the outside air pressure. At this point, the water in the water tank body may flow into the mopping cloth to wet the mopping cloth under the action of gravity. However, when the mopping cloth is fully wet, the air inlet hole will be blocked. Therefore, the air at the air inlet hole is closed, that is, no outside air is sucked in, and then the air in the air passage and in the water tank body will be in a relatively vacuum pressure state, and the water in the water tank body will no longer flow out under the action of gravity, that is, the water in the water tank body will be maintained in the water tank body based on suction and closure of the air, so as to achieve the technical effect of water stoppage.

Through the above steps, the technical effect of automatic water stoppage when the mopping module is laid flat may be achieved. Meanwhile, when the mopping cloth is short of water, the mopping cloth may be infiltrated with a structure such as the water outlet hole, so as to achieve the technical effect that the ground may be cleaned at any time.

FIG. 1 to FIG. 5 are alternative embodiments of the present disclosure. According to a specific embodiment of the present disclosure, there is provided a mopping module, including: a water tank, a mopping cloth 18 provided on the outside of the bottom of the water tank, a water amount control mechanism, a water passing channel 53 at the bottom of the water tank, a water tank hole 15 and a water outlet hole 54. The water amount control mechanism includes a knob and a water control tray. The cooperation of the water control tray and the water tank hole 15 may be controlled via the knob to adjust the amount of water entering into the water passing channel 53 from the water tank through the water tank hole 15.

The water tank hole 15 may be a plurality of holes of different sizes, and the water control tray has a water control hole 24 therethrough, and the water control tray is rotated to control the water control hole 24 to be communicated with the water tank holes 15 of different sizes so as to control the amount of water.

There is one water tank hole 15, and the water control tray has a water control hole 24 therethrough, and the water control tray is rotated to adjust an overlapping area between the water tank hole 15 and the water control hole 24 so as to control the amount of water.

The water tank further includes a water tank bottom-cover 13. The water tank bottom-cover 13 is provided between the water tank and the mopping cloth 18. The water passing channel 53 is provided between the water tank bottom-cover 13 and the water tank. The water outlet hole 54 is provided on the water tank bottom-cover 13. The water tank hole 15 is communicated with the water outlet hole 54 through the water passing channel 53. The water tank hole 15 is communicated with an interior of the water tank. The water outlet hole 54 is communicated with the mopping cloth 18.

The outer lower surface of the water tank is partially recessed upwardly to form a water passing groove 16. A water passing channel 53 is formed between the water tank bottom-cover 13 and the water passing groove 16. The water control tray of the knob rod 23 is located within the water passing channel 53, and the water control tray may be rotatable and upwardly and downwardly movable in the water passing channel 53. The water in the water tank is released to the mopping cloth 18 through the water passing groove 16 and the water outlet hole 54.

The knob includes a knob upper-cover 21, a knob screw 22 and a knob rod 23 which are fixedly connected in sequence from top to bottom. The knob upper-cover 21 is provided on an upper surface of the water tank. The knob rod 23 is rotatably penetrated into the water tank. The knob rod 23 has a step-shaped columnar rod body with a smaller-diameter upper portion and a larger-diameter lower portion. An annular water control tray is integrally provided outside a lower end of the knob rod 23.

An upper outer surface of the water tank is partially recessed downwardly to form a rotary accommodating groove. A side wall of the rotary accommodating groove is provided with a recessed portion. Steel ball holes are symmetrically provided on both sides of the knob upper-cover 21. A knob steel ball spring 26 and a knob steel ball 25 are sequentially mounted in a steel ball hole from inside to outside. The knob upper-cover 21 is embedded and mounted in the rotary accommodating groove. The knob steel ball 25 abuts against the recessed portion of the side wall of the rotary accommodating groove.

An inner lower surface of the water tank is integrally provided with an annular columnar water tank lower-bracket. A baffle ring is integrally provided in the water tank lower-bracket. The knob rod 23 is sleeved with a button spring 27. An upper end and a lower end of the button spring 27 respectively abut against the knob upper-cover 21 and the water tank lower-bracket.

An inner hole of the baffle ring is smaller than an annular inner hole of the water tank lower-bracket. An upper end surface of the knob rod 23 has a threaded hole. An upper end of the knob rod 23 passes through the inner hole of the baffle ring in the water tank lower-bracket. The knob screw 22 is screwed with the threaded hole of the knob rod 23.

A circular groove is provided under the knob upper-cover 21. An upper end of the button spring 27 abuts against the circular groove under the knob upper-cover 21, and a lower end of the button spring 27 abuts against the baffle ring within the water tank lower-bracket. The knob upper-cover 21 and the knob rod 23 move upwardly under the action of a restoring force of the button spring 27.

According to a specific embodiment of the present disclosure, there is provided a mopping module, including: a knob upper-cover 21, a knob screw 22, a knob rod 23, a button spring 27, a water tank, and a mopping cloth. The water tank includes a water tank upper-case 11, a water tank lower-case 12, and a water tank bottom-cover 13. The water tank upper-case 11 and the water tank lower-case 12 are engaged and sealingly connected to form a hollow water tank main body. The knob upper-cover 21, the knob screw 22, and the knob rod 23 are sequentially arranged from top to bottom. The knob upper-cover 21 is provided on an upper surface of the water tank upper-case 11. The knob rod 23 is rotatably penetrated into the water tank lower-case 12. The knob upper-cover 21 and the knob rod 23 are fixedly connected together by the knob screw 22. The knob rod 23 is sleeved with the button spring 27. An upper end and a lower end of the button spring 27 respectively abut against the knob upper-cover 21 and a water tank lower-bracket 14 within the water tank lower-case 12. The water tank bottom-cover 13 is covered and detachably mounted on a lower outer surface of the water tank lower-case 12. The mopping cloth is covered and detachably mounted on a lower surface of the water tank bottom-cover 13. The water tank lower-case 12 is provided with a water tank hole 15. The water control tray of the knob rod 23 is provided with a water control hole 24. The water control hole 24 cooperates with the water tank hole 15 to regulate and release the water in the water tank main body.

An upper outer surface of the water tank upper-case 11 is partially recessed downwardly to form a rotary accommodating groove. A side wall of the rotary accommodating groove is provided with a recessed portion. The knob upper-cover 21 is a rotary body. Steel ball holes are symmetrically provided on both sides of the knob upper-cover 21. A knob steel ball spring 26 and a knob steel ball 25 are sequentially mounted in a steel ball hole from inside to outside. The knob upper-cover 21 is embedded and mounted in the rotary accommodating groove. The knob steel ball 25 abuts against the recessed portion of the side wall of the rotary accommodating groove.

A lower inner surface of the water tank lower-case 12 is integrally provided with an annular columnar water tank lower-bracket 14. A baffle ring is integrally provided in the water tank lower-bracket 14. A plurality of through water tank holes 15 is provided on a bottom case of the water tank lower-case 12 close to the water tank lower-bracket 14. The knob rod 23 has a step-shaped columnar rod body with a smaller-diameter upper portion and a larger-diameter lower portion. An annular water control tray is integrally provided outside a lower end of the knob rod 23. The annular water control tray is provided with a water control hole 24 therethrough. The water control hole 24 cooperates with the water tank hole 15 to regulate the amount of water.

There are two water tank holes 15, which are respectively a first water tank hole and a second water tank hole, and the two water tank holes 15 are circumferentially distributed along the water tank lower-bracket 14, and respectively correspond to the positions of two different operating position markers. The two water tank holes 15 have different sectional areas. The recessed portions of the side walls of the rotary accommodating groove are symmetrically provided, and are respectively provided at the positions corresponding to the respective operating position markers, or are provided as spiral grooves.

A sectional area of the water control hole 24 is greater than or equal to that of the second water tank hole. An inner hole of the baffle ring is smaller than an annular inner hole of the water tank lower-bracket 14. An upper end surface of the knob rod 23 has a threaded hole. An upper end of the knob rod 23 passes through the inner hole of the baffle ring in the water tank lower-bracket 14. The knob screw 22 is screwed with the threaded hole of the knob rod 23.

The lower outer surface of the water tank lower-case 12 is partially recessed upwardly to form a water passing groove 16. The water tank bottom-cover 13 is covered and detachably mounted on the lower outer surface of the water tank lower-case 12. The water tank bottom-cover 13 is provided with a water outlet hole 54 therethrough. A water passing channel 53 is formed between the water tank bottom-cover 13 and the water passing groove 16. The water control tray of the knob rod 23 is located within the water passing channel, and the water control tray may be rotatable and upwardly and downwardly movable in the water passing channel. The water in the water tank main body flows through the water passing groove 16 and the water outlet hole 54 to be released to the mopping cloth.

The water passing channel 53 is provided in the edge of the lower surface of the water tank lower-case 12. The water passing channel 53 may be arranged as a main path in an equidistant offset corresponding to the shape of the edge of the lower surface of the water tank lower-case 12, or may be further arranged as a plurality of main paths in an equidistant offset inwardly, and the plurality of main paths are communicated by branch paths.

The water outlet holes 54 are evenly distributed along one or more horizontal main paths of the water passing channel 53, and the horizontal positions where the water outlet holes 54 are suspended are higher than the horizontal positions where the water tank holes 15 are suspended.

The water outlet holes 54 are evenly distributed in arithmetic progression on one side of the mopping module, a hole site of each of the water outlet holes 54 is a perfect circle, and a center-to-center distance of each two adjacent water outlet holes 54 is lcm.

The water tank hole 15 is used as the hole through which the water of the water tank of the mopping module flows out, and the water in the water tank may be brought into the mopping cloth of the mopping module through the water outlet hole 54. The water outlet hole 54 is communicated with the water tank hole 15 through the water passing channel 53. The water passing channel 53 is a channel which is formed by recession inwardly of the mopping module chassis above the mopping cloth and through which the water may pass, and this channel may be provided as a curved water passing channel 53.

The mopping cloth is connected with the air inlet pipeline, and the air inlet pipeline adjusts the air pressure in the water tank of the mopping module by sucking in air or not, so as to open and close the water discharge of the mopping module, to limit the continuous outflow of the water in the water tank. Meanwhile, when the mopping cloth is short of water, the mopping cloth is infiltrated with a structure such as the water outlet hole 54, so as to achieve the technical effect that the ground may be cleaned at any time.

In addition, in the process of using the embodiment of the present disclosure, when the add-on type mopping module is in a suspended state, no matter whether a water amount control knob of the water tank is in the large water operating position or in the small water operating position, the water will not flow out from the water outlet hole 54 of the water passing channel 53. As shown in figures, the position of the water tank hole 15 is lower than the position of the water outlet hole 54. Due to the action of gravity, the water will not flow upwardly to the water outlet hole 54 during suspension of the mopping module. Meanwhile, due to the action of the wet mopping cloth, the air in the water tank body is closed, so as to achieve the effect of water stoppage.

A circular groove is provided under the knob upper-cover 21. An upper end of the button spring 27 abuts against the circular groove under the knob upper-cover 21, and a lower end of the button spring 27 abuts against the baffle ring within the water tank lower-bracket 14. The knob upper-cover 21 and the knob rod 23 move upwardly under the action of a restoring force of the button spring 27.

A water tank Velcro 17 is mounted on a lower side of the water tank bottom-cover 13. The water tank Velcro 17 is connected to the water tank bottom-cover 13 by bonding. The mopping cloth and the water tank bottom-cover 13 are detachably connected through the water tank Velcro 17.

In some embodiments, in order to achieve the technical purpose of controlling the release of water by the mopping cloth in the embodiments of the present disclosure, as shown in FIG. 1 to FIG. 4, the knob rod 23 has a step-shaped columnar rod body, an upper end of the knob rod 23 is a small end of the step-shaped columnar rod body, and a lower end thereof is a large end of the step-shaped columnar rod body; a sectional area of the water control hole 24 is greater than or equal to a sectional area of the second water tank hole, and the upper end of the knob rod 23 passes through the inner hole of the baffle ring within the water tank lower-bracket 14.

The knob upper-cover 21 rotates so that the rigidly fixed knob rod 23 rotates to rotate the annular water control tray at the lower end of the knob rod 23, and so that the water control hole 24 of the water control tray moves circumferentially with the rotational movement. The water control hole 24 is not communicated with any of the water tank holes 15 when the knob is at a zero operating position marker; the water control hole 24 is communicated with the first water tank hole when the knob is at a first operating position marker, and the water control hole 24 is communicated with the second water tank hole when the knob is at a second operating position marker.

The knob upper-cover 21, the knob screw 22, and the knob rod 23 are sequentially arranged from top to bottom. The knob upper-cover 21 is rigidly fixed to the knob rod 23 through the knob screw 22. The knob rod 23 is sleeved with a button spring 27. The button spring 27 may be mounted by welding or fitting. An upper end and a lower end of the button spring 27 respectively abut against the knob upper-cover 21 and the water tank lower-bracket 14.

After the knob rotates, the knob rod 23 is under the action of the restoring force of the button spring 27, and an upper surface of the water control tray at the lower end of the knob rod 23 quickly and closely contacts a lower surface of the bottom case of the water tank lower-case 12, thereby preventing that the water will leak out from the water tank holes 15 when the water control hole 24 is not communicated with any of the water tank holes 15, and maintaining a good seal.

Meanwhile, when a user implements the embodiment of the present disclosure, after the knob is pressed down, the knob steel ball 25 will disengage from the recessed portion of the side wall of the rotary accommodating groove, and the operating positions of the knob upper-cover 21 will be unlocked. At this point, the knob upper-cover 21 may be arbitrarily rotated to the corresponding operating position, and then the knob is released, the knob upper-cover 21 moves upwardly under the action of the restoring force of the button spring 27; and when the knob upper-cover 21 moves to the recessed portion of the side wall of the rotary accommodating groove, the knob steel ball 25 on the side of the knob upper-cover 21 abuts against the recessed portion of the side wall of the rotary accommodating groove again under the force of the knob steel ball spring 26, so as to automatically lock the operating position of the knob upper-cover 21 again, ensuring that the operating position returns to the correct position when toggled.

Furthermore, a rebound force generated by the knob after rotation will provide the user with a feedback force, which allows the user to feel the tactile change when rotating the operating position, brings a better comfort of rotating operation, and improves the user's experience when using the knob to adjust the amount of water, and meanwhile makes the process of adjusting the amount of water more precise and controllable.

It should be noted that the mopping cloth is connected to the bottom of the water tank lower-case 12. The mopping cloth is configured to clean the ground and is the main body that is acted upon when the water is released, and may be made of a textile. The water is released through the control device to infiltrate the mopping cloth assembly, so as to achieve the technical purpose of infiltrating the mopping cloth assembly at any time for cleaning.

In some embodiments, the knob upper-cover 21 is a rotary body, a circular groove is provided under the knob upper-cover 21, and the knob screw 22 is rigidly embedded in the circular groove. A knob deco 28 is mounted on an upper side of the knob upper-cover 21 to instruct the user to position an operating position marker when rotating the knob upper-cover 21. The knob deco 28 is made of corrosion-resistant hard plastic and is rigidly connected to the knob upper-cover 21. The knob upper-cover 21 is a perfectly circular component, and a protrusion is provided along a vertical radius of the center of the knob device, and the knob deco 28 is provided on an upper surface of the protrusion. The knob steel balls 25 and the knob steel ball springs 26 are mounted on both sides of the knob upper-cover 21 by means of abutting against and linkage with the water tank upper-case 11.

In some embodiments, steel ball holes are symmetrically provided on both sides of the knob upper-cover 21. A knob steel ball spring 26 and a knob steel ball 25 are sequentially mounted in a steel ball hole from inside to outside. The knob steel ball spring 26 provides a thrust force towards the outside of the hole, so that the knob steel ball 25 abuts against the recessed portion of the side wall of the rotary accommodating groove, and an axis of the steel ball hole is perpendicular to an axis of the knob screw 22.

The knob steel ball 25 is a rigid spherical body and forms an interference fit with the recessed portion of the side wall of the rotary accommodating groove.

In some embodiments, a water tank Velcro 17 is mounted on a lower side of the water tank bottom-cover 13. The water tank Velcro 17 is connected to the water tank bottom-cover 13 by bonding. The mopping cloth and the water tank bottom-cover 13 are connected through the water tank Velcro 17. In order to facilitate the user to mount the mopping cloth of the mopping module, the water tank Velcro 17 is bonded at the bottom of the water tank by solid glue, and the mopping cloth of the mopping module is affixed or removed through the water tank Velcro 17.

According to another aspect of the embodiments of the present disclosure, there is provided a mopping module, the mopping module includes the above-mentioned water amount control knob device 2, and a water tank 1, a mopping cloth cleaning mechanism 3, a pedal linkage assembly 4, and an air inlet pipeline. The mopping cloth cleaning mechanism 3 is provided at one end of an upper portion of the water tank 1, and the water amount control knob device 2 and the pedal linkage assembly 4 are symmetrically provided at both sides of the other end of the upper portion of the water tank 1. The air inlet pipeline is communicated with the water tank 1.

The water tank includes a water tank upper-case 11, a water tank lower-case 12, a water tank bottom-cover 13, a water tank Velcro 17, and a mopping cloth. The edges of the water tank upper-case 11 extend downwardly, and the edges of the water tank lower-case 12 extend upwardly. The water tank upper-case 11 and the water tank lower-case 12 are engaged and sealingly connected through the edges thereof to form a hollow water tank main body. The water tank bottom-cover 13 is detachably covered and mounted on a lower outer surface of the water tank lower-case 12. The mopping cloth is covered and detachably mounted on a lower surface of the water tank bottom-cover 13 through the water tank Velcro 17.

The water tank main body is used for water storage, and thus the water tank upper-case and the water tank lower-case are connected rigidly and water-tightly, and the seam between them may be formed by bonding or by hot pressing, and which connection manner is adopted is not In some embodiments limited here.

The water tank bottom-cover 13 is provided with a water outlet hole therethrough. The lower outer surface of the water tank lower-case 12 is partially recessed upwardly to form a water passing groove 16. The water passing channel is communicated with the water outlet hole. A lower inner surface of the water tank lower-case 12 is integrally provided with an annular columnar water tank lower-bracket 14 therethrough. A baffle ring is integrally provided in the water tank lower-bracket 14. An inner hole of the baffle ring is smaller than an annular inner hole of the water tank lower-bracket 14. A plurality of through water tank holes 15 is provided on a bottom case of the water tank lower-case 12 close to the water tank lower-bracket 14.

An upper outer surface of the water tank upper-case 11 is partially recessed downwardly to form a rotary accommodating groove. A side wall of the rotary accommodating groove is provided with a recessed portion. There are two water tank holes 15, the two water tank holes 15 are circumferentially distributed along the water tank lower-bracket 14, and respectively correspond to the positions of two different operating position markers. The two water tank holes 15 have different sectional areas.

Preferably, a sectional area of a second water tank hole is 2 to 4 times of a sectional area of a first water tank hole. The recessed portions of the side walls of the rotary accommodating groove are symmetrically provided, and are respectively provided at the positions corresponding to the respective operating position markers. Alternatively, the recessed portions of the side walls of the rotary accommodating groove are provided as spiral grooves.

In addition, during the use of the embodiment of the present disclosure, there are three knob operating position markers, namely a zero operating position corresponding to no water, a first operating position corresponding to small water, and a second operating position corresponding to large water. The knob rod 23 is mounted from the bottom of the water tank lower-case 12 into the water tank lower-bracket 14. The knob rod 23 protrudes from an upper end of the water tank lower-bracket 14. The knob rod 23 is sleeved with a knob spring. Then, two knob steel ball springs 26 are mounted on the sides of the knob upper-cover 21, and the knob steel balls 25 are mounted simultaneously. Finally, the knob upper-cover 21 is mounted on the water tank upper-case 11 by fixing the knob screw 22 to the upper end of the knob rod 23. The knob rotates in a clockwise direction, and an operating position is positioned during the rotation of the knob through the recessed portion of the side wall of the rotary accommodating groove of the water tank upper-case 11. The water control tray at the lower end of the knob rod 23 is in contact with and engaged with the water tank lower-case 12. The knob rod 23 always acts upwardly by the button spring 27. The knob rod 23 is maintained in close contact with the water tank lower-case 12, and it is ensured that the water tank will not leak. The water control tray at the lower end of the knob rod 23 is provided with the water control hole 24, and the bottom case of the water tank lower-case 12 has two water tank holes 15. When the knob is rotated to an operating position, the water control hole 24 is communicated or not communicated with different water tank holes 15, so as to adjust and control the amount of water.

Through the above steps, it is possible to conveniently and quickly use the water amount control function to control the amount of water to infiltrate the mopping cloth.

FIG. 1 to FIG. 5 are alternative embodiments of the present disclosure. According to a specific embodiment of the present disclosure, there is provided a mopping module, including: a water tank and a mopping cloth 18 provided at the bottom of the water tank, one or more water outlet holes 54, a water passing channel 53, and a water tank hole 15. The water tank hole 15, the water passing channel 53, and the water outlet holes 54 form a channel for the water flowing from the water tank to the mopping cloth 18. When the water tank is in a suspended state, one or more water outlet holes 54 are higher than the water tank hole 15.

The water stoppage by suspension is based on the fact that a height of a plane where the water outlet hole 54 is located is higher than a height of the water tank hole 15 of the water passing channel 53. When the water tank is suspended, due to the above height difference, the water in the water tank may be discharged from the water outlet hole 54 by overcoming the above pressure difference. The water in the water outlet hole 54 cannot seep out from the water outlet hole 54 because of the presence of the above pressure difference.

The water tank hole 15 is located on the inner wall of the bottom of the water tank and is communicated with the interior of the water tank.

A water tank bottom-cover 13 is provided between the water tank and the mopping cloth 18, and the water outlet hole 54 is located on a lower side of the water tank bottom-cover 13 and is communicated with the mopping cloth 18.

The water passing channel 53 is located on an upper side of the water tank bottom-cover 13, and the water passing channel 53 extends from the water tank hole 15 to one or more water outlet holes 54.

The water passing channel 53 has at least two horizontal channels and vertical channels, and the horizontal channels are communicated through the vertical channels.

When the water tank is suspended, the water tank hole 15 is located in a horizontal channel at the lowest horizontal position, and a plurality of water outlet holes 54 are distributed in the horizontal channels at the remaining horizontal positions.

An upper surface of the water tank bottom-cover 13 is partially recessed downwardly to form the water passing channel 53.

When the water tank is suspended, the plurality of water outlet holes 54 may be located at different heights.

When the water tank is suspended, the plurality of water outlet holes 54 is located at the same height.

When the water tank is suspended, the highest point of the water passing channel 53 is higher than each of one or more water outlet holes 54.

According to another specific embodiment of the present disclosure, there is provided another mopping module, including: an air inlet hole 52, a water outlet hole 54, a water passing channel 53, an air inlet pipeline 51, and a water tank. The water tank includes a water tank upper-case 11, a water tank lower-case 12, a water tank bottom-cover 13, and a mopping cloth 18. The water tank upper-case 11 and the water tank lower-case 12 are engaged and sealingly connected to form a hollow water tank main body. The water tank bottom-cover 13 is covered and detachably mounted on a lower outer surface of the water tank lower-case 12. The mopping cloth 18 is covered and detachably mounted on a lower surface of the water tank bottom-cover 13. The water passing channel 53 is formed between the water tank bottom-cover 13 and the water passing groove. The water tank bottom-cover 13 is provided with at least one water outlet hole 54 therethrough. At least one air inlet hole is protruded from the lower outer surface of the water tank lower-case 12. A plurality of through water tank holes 15 is provided at a position of the lower surface of the water tank lower-case 12 corresponding to the water amount control mechanism. When the water tank is suspended, the horizontal position where the water outlet hole 54 is suspended is higher than the horizontal position where the water tank holes 15 are suspended.

The air inlet hole extends non-communicatively through the water tank bottom-cover 13 and is in contact with the upper surface of the mopping cloth 18. The air inlet hole is communicated with the air inlet pipeline 51.

The air inlet holes may be communicated with the air inlet pipeline 51 through a triangular section channel with multi-communication, or the air inlet holes may be respectively communicated with the air inlet pipeline 51.

The air inlet pipeline 51 is annular columnar. One end of the air inlet pipeline 51 extends downwardly and protrudes from a lower surface of the water tank lower-case 12. One end of the air inlet pipeline 51 extends downwardly and non-communicatively through the water tank bottom-cover 13. A lower extending end surface thereof is provided with an air inlet hole 52 and is in contact with the upper surface of the mopping cloth 18. The air intake pipeline 51 communicates an interior of the water tank main body and the mopping cloth 18.

The other end of the air inlet pipeline 51 extends upwardly and protrudes into the interior of the water tank upper-case 11, and an upper extending end surface of the other end of the air inlet pipeline 51 is not in contact with an upper inner surface of the water tank upper-case 11.

The water passing channel 53 is provided in the edge of the lower surface of the water tank lower-case 12. The water passing channel 53 is arranged as a main path in an equidistant offset corresponding to the shape of the edge of the lower surface of the water tank lower-case 12, or is further arranged as a plurality of main paths in an equidistant offset inwardly, and the plurality of main paths is connected by branch paths.

The water outlet holes 54 are evenly distributed along a horizontal main path of the water passing channel 53. The air inlet holes 52 are evenly distributed along another horizontal main path of the water passing channel 53, or the air inlet holes 52 and the water outlet holes 54 are located at the same horizontal position along the horizontal main paths of the water passing channel 53.

A plurality of through water tank holes 15 is provided at a position of the lower surface of the water tank lower-case 12 corresponding to the water amount control mechanism. The water outlet hole 54 may be communicated with the water tank holes 15 through the water passing channel 53, so that the water in the water tank main body may be discharged to the mopping cloth 18.

The lower outer surface of the water tank lower-case 12 is partially recessed upwardly to form a water passing groove, and the position of the water tank bottom-cover 13 corresponding to the water passing groove is recessed downwardly to form a bottom-cover water passing groove.

The mopping cloth 18 is made of a textile which readily absorbs water. A bottom end of the air inlet hole 52 is closely attached to the water absorbent textile of the mopping cloth 18, and the water absorbent textile expands after absorbing water and closes the air inlet hole 52.

In some embodiments, the water tank hole 15 in the embodiments of the present disclosure is used as the hole through which the water of the water tank of the mopping module flows out, and the water in the water tank may be brought into the mopping cloth of the mopping module through the water outlet hole 54. The water outlet hole 54 is communicated with the water tank hole 15 through the water passing channel 53. The water passing channel 53 is a channel which is formed by recession inwardly of the mopping module chassis above the mopping cloth and through which the water may pass, and this channel may be provided as a curved water passing channel 53.

In some embodiments, the water tank hole 15 is communicated with the water amount control mechanism for controlling the amount of discharged water. The water tank hole 15 is communicated with several flange holes at the bottom of the water amount control mechanism.

In some embodiments, the water tank hole 15 is communicated with the water amount control mechanism of the water tank in some embodiments. When the user controls the water amount control mechanism of the water tank, the amount of water discharged from the water tank hole 15 is affected.

In some embodiments, the water outlet holes 54 are evenly distributed in arithmetic progression on one side of the mopping module, a hole site of each of the water outlet holes 54 is a perfect circle, and a center-to-center distance of each two adjacent water outlet holes 54 is 1 cm.

In some embodiments, an upper portion of the water tank body is provided with a circular recessed portion, and the circular recessed portion is in clearance fit with an air inlet channel of the water tank to form an upper communication structure, for inputting the air introduced through the air inlet hole 52 of the water tank into the water tank body through the air inlet channel.

In some embodiments, the above-mentioned water tank body is configured to accommodate water for cleaning. The air inlet hole 52 of the water tank, as a key mechanism for determining whether the water for cleaning stops sinking into the mopping cloth of the mopping module, needs to form the upper communication structure with the air inlet hole 52 of the water tank. The upper communication structure may be a gap of not more than 1 mm, which is integrally recessed and formed during preparation of the water tank body, for avoiding damage to the mopping module when cleaning the ground. The gap between the air inlet hole 52 of the water tank and the water tank body of the upper communication structure is used to input the air introduced through the air inlet hole 52 of the water tank into the water tank body.

An upwardly recessed portion is provided at a position of the water tank upper-case 11 corresponding to the air inlet pipeline 51. An upper extending end at the other end of the air inlet pipeline 51 is inserted with a clearance fit into the recessed portion. An upper extending end surface of the other end of the air inlet pipeline 51 is not in contact with a bottom surface of the recessed portion of the water tank upper-case 11.

A distance of less than 1 mm is maintained between the upper extending end surface of the other end of the air inlet pipeline 51 and the bottom surface of the recessed portion of the water tank upper-case 11.

Preferably, a distance of 0.5 mm is maintained between the upper extending end surface of the other end of the air inlet pipeline 51 and the bottom surface of the recessed portion of the water tank upper-case 11.

The upper extending end surface of the other end of the air inlet pipeline 51 is provided with an opening groove. The opening groove has a depth smaller than a depth of the recessed portion, and is used to increase the area for the air entering into the water tank main body, and meanwhile to prevent impurities in the water in the water tank main body from blocking the air inlet pipeline 51. The opening groove may be cross-shaped or may be provided in the form of symmetrical notches, which will not be described in detail here.

In some embodiments, in order to make the mopping cloth of the mopping module be fully infiltrated with water, the water from the water outlet holes 54 transported by the water passing channel 53 needs to evenly infiltrate into the mopping cloth, and thus the water outlet holes 54 are evenly distributed at one side of the mopping module. The number of the water outlet holes 54 may be one or more, and the water outlet holes 54 are arranged according to the actual situation, and the specific number thereof is not In some embodiments limited here.

In addition, in the process of using the embodiment of the present disclosure, when the add-on type mopping module is in a suspended state, no matter whether a water amount control knob of the water tank is in the large water operating position or in the small water operating position, the water will not flow out from the water outlet hole 54 of the water passing channel 53. As shown in the figures, the position of the water tank hole 15 is lower than the position of the water outlet hole 54. Due to the action of gravity, the water will not flow upwardly to the water outlet hole 54 during suspension of the mopping module. Meanwhile, due to the action of the wet mopping cloth, the air in the water tank body is closed, so as to achieve the effect of water stoppage.

In addition, during the process of suspending the mopping module, the amount of water in the water tank of the mopping module is controlled by the action of the mopping cloth and the air inlet hole 52, so that the air inlet hole 52 may be blocked when the user suspends the mopping cloth, so as to limit continuous outflow of the water in the water tank, and meanwhile, when the mopping cloth is short of water, the mopping cloth is infiltrated with a structure such as the water outlet hole 54, so as to achieve the technical effect that the ground may be cleaned at any time.

Through the above steps, it is possible to achieve the technical effect of automatic water stoppage when the mopping module is suspended.

FIG. 1 to FIG. 7 are alternative embodiments of the present disclosure. According to some embodiments of the present disclosure, there is provided a mopping module, including: an air inlet pipeline 51, an air inlet hole 52, and a water tank. The water tank includes a water tank bottom-cover 13, and a mopping cloth 18. The water tank bottom-cover 13 is provided at a lower portion of the water tank. The mopping cloth 18 is provided at a lower portion of the water tank bottom-cover 13. The air inlet hole 52 is provided on the water tank bottom-cover 13. The air inlet pipeline 51 is fixedly provided within the water tank, and is communicated with the air inlet hole 52.

Further, the air inlet pipeline 51 is a rigid pipe extending upwardly within the water tank, and an end thereof extends to an upper wall of an inner side of the water tank and is spaced from the upper wall by a certain distance.

Further, the end of the air inlet pipeline 51 is spaced from the upper wall of the inner side of the water tank by a distance less than 1 mm.

Further, the mopping cloth 18 covers the air inlet hole 52. In the non-water-stop state, a surface of the mopping cloth 18 is spaced from the air inlet hole 52 by a certain distance. In the water-stop state, the surface of the mopping cloth 18 blocks the air inlet hole 52.

Further, the surface of the mopping cloth 18 is spaced from the air inlet hole 52 by a distance less than 3 mm. When the mopping cloth 18 is laid flat, if the distance between the mopping cloth 18 and the air inlet hole 52 is too large, the air inlet hole 52 cannot be blocked even if the mopping cloth 18 is wet and absorbs water. Consequently, the effect of water stoppage cannot be achieved.

Further, the mopping cloth 18 is made of a water absorbent textile material, and the water absorbent textile expands after absorbing water. The air inlet hole 52 is closely attached to the mopping cloth 18 to close the air inlet hole 52.

Further, one or more radial grooves with the air inlet hole 52 as the center are provided around the air inlet hole 52 on the lower surface of the water tank bottom-cover 13. Through the radial grooves, the mopping cloth 18 gradually expands along these radial grooves during water absorption of the mopping cloth 18, so that the air inlet hole 52 is blocked gradually, so as to realize the reliability of water stoppage.

Further, a water outlet hole 54 is provided on the water tank bottom-cover 13. A water tank hole 15 is provided at the bottom of the water tank. A water passing channel 53 is provided between the water tank and the water tank bottom-cover 13. The water tank hole 15 and the water outlet hole 54 are communicated through the water passing channel 53.

Further, there is at least one water outlet hole 54, and the water outlet hole 54 is provided at a corresponding position of the water passing channel 53.

Further, the mopping cloth 18 covers the water outlet hole 54, and the surface of the mopping cloth 18 is spaced from the water outlet hole 54 by a distance less than 1 mm.

According to some embodiments of the present disclosure, there is provided a mopping module, including: an air inlet pipeline 51, an air inlet hole 52, a water passing channel 53, and a water tank. The water tank includes a water tank upper-case 11, a water tank lower-case 12, a water tank bottom-cover 13, and a mopping cloth 18. The water tank upper-case 11 and the water tank lower-case 12 are engaged and sealingly connected to form a hollow water tank main body. The water tank bottom-cover 13 is covered and detachably mounted on a lower outer surface of the water tank lower-case 12. A water passing channel 53 is formed between the water tank bottom-cover 13 and the water passing groove. The water tank bottom-cover 13 is provided with a water outlet hole 54 therethrough. The mopping cloth 18 is covered and detachably mounted on a lower surface of the water tank bottom-cover 13. The air inlet pipeline 51 communicates an interior of the water tank main body and the mopping cloth 18.

The air inlet pipeline 51 is annular columnar. One end of the air inlet pipeline 51 extends downwardly and protrudes from a lower surface of the water tank lower-case 12. One end of the air inlet pipeline 51 extends downwardly and non-communicatively through the water tank bottom-cover 13, and a lower extending end surface thereof is provided with an air inlet hole 52 and is in contact with the upper surface of the mopping cloth 18.

The other end of the air inlet pipeline 51 extends upwardly and protrudes into the interior of the water tank upper-case 11, and an upper extending end surface of the other end of the air inlet pipeline 51 is not in contact with an upper inner surface of the water tank upper-case 11.

The distance between an upper extending end surface of the other end of the air inlet pipeline 51 and an upper inner surface of the water tank upper-case 11 is less than 1 mm.

Preferably, the distance between the upper extending end surface of the other end of the air inlet pipeline 51 and the upper inner surface of the water tank upper-case 11 is 0.5 mm.

The lower outer surface of the water tank lower-case 12 is partially recessed upwardly to form a water passing groove, and the position of the water tank bottom-cover 13 corresponding to the water passing groove is recessed downwardly to form a bottom-cover water passing groove, so as to increase a sectional area of the water passing channel 53 to improve a discharge amount of water.

A plurality of through water tank holes 15 is provided at a position of the lower surface of the water tank lower-case 12 corresponding to the water amount control mechanism. The water outlet hole 54 may be communicated with the water tank holes 15 through the water passing channel 53, so that the water in the water tank main body may be discharged to the mopping cloth 18.

The water passing channel 53 is provided in the edge of the lower surface of the water tank lower-case 12. The water passing channel 53 may be arranged as a main path in an equidistant offset corresponding to the shape of the edge of the lower surface of the water tank lower-case 12, or may be further arranged as a plurality of main paths in an equidistant offset inwardly, and the plurality of main paths is connected by branch paths.

The water tank bottom-cover 13 is provided with at least one water outlet hole 54 therethrough, and the water passing groove is communicated with the water outlet hole 54 through the water passing channel 53, and the water passing channel 53 has a horizontal main path and a vertical branch path.

The mopping cloth 18 is made of a textile which readily absorbs water. A bottom end of the air inlet hole 52 is closely attached to the water absorbent textile of the mopping cloth 18, and the water absorbent textile expands after absorbing water and closes the air inlet hole 52.

In some embodiments, when using the embodiments of the present disclosure, the user needs to lay the mopping module flat, so that when the mopping module is laid flat, the water in a water tank body will not overflow to cause pollution. The water tank body is provided to store water for cleaning needed for the mopping cloth in the mopping module. And, an air inlet hole 52 of the water tank is provided to communicate an air pressure in the water tank body with an external atmospheric pressure, so that when the internal pressure is equal to the external pressure, the water in the water tank body automatically sinks into and infiltrates the mopping cloth of the mopping module only under the action of gravity. Therefore, when the air inlet hole 52 of the water tank is blocked by the wet mopping cloth, the air inlet hole 52 of the water tank cannot obtain the external atmospheric pressure, and thus the water in the water tank will not drop to the mopping cloth of the mopping module under the action of gravity, and the space in the water tank body will further be in a relatively vacuum state.

In some embodiments, an upper portion of the water tank body is provided with a circular recessed portion, and the circular recessed portion is in clearance fit with an air inlet channel of the water tank to form an upper communication structure, for inputting the air introduced through the air inlet hole 52 of the water tank into the water tank body through the air inlet channel.

In some embodiments, the above-mentioned water tank body is configured to accommodate water for cleaning. The air inlet hole 52 of the water tank, as a key mechanism for determining whether the water for cleaning stops sinking into the mopping cloth of the mopping module, needs to form the upper communication structure with the air inlet hole 52 of the water tank. The upper communication structure may be a gap of not more than 1 mm, which is integrally recessed and formed during preparation of the water tank body, for avoiding damage to the mopping module when cleaning the ground. The gap between the air inlet hole 52 of the water tank and the water tank body of the upper communication structure is used to input the air introduced through the air inlet hole 52 of the water tank into the water tank body.

An upwardly recessed portion is provided at a position of the water tank upper-case 11 corresponding to the air inlet pipeline 51. An upper extending end at the other end of the air inlet pipeline 51 is inserted with a clearance fit into the recessed portion. An upper extending end surface of the other end of the air inlet pipeline 51 is not in contact with a bottom surface of the recessed portion of the water tank upper-case 11.

A distance of less than 1 mm is maintained between the upper extending end surface of the other end of the air inlet pipeline 51 and the bottom surface of the recessed portion of the water tank upper-case 11.

In some embodiments, a distance of 0.5 mm is maintained between the upper extending end surface of the other end of the air inlet pipeline 51 and the bottom surface of the recessed portion of the water tank upper-case 11.

The upper extending end surface of the other end of the air inlet pipeline 51 is provided with an opening groove. The opening groove has a depth smaller than a depth of the recessed portion, and is used to increase the area for the air entering into the water tank main body, and meanwhile to prevent impurities in the water in the water tank main body from blocking the air inlet pipeline 51. The opening groove may be cross-shaped or may be provided in the form of symmetrical notches, which will not be described in detail here.

In some embodiments, a rubber sealing ring having the same outer diameter as the air inlet hole 52 of the water tank is mounted at the bottom of the air inlet hole 52 of the water tank to prevent outside air from entering into the air inlet hole 52 of the water tank when the air is closed.

In some embodiments, in order to make the air inlet hole 52 of the water tank reach a sealed state except for the influence of the mopping cloth of the mopping module when the air enters and exits, a rubber sealing ring may be mounted at the bottom end of the air inlet hole 52 of the water tank, and the rubber sealing ring may be bonded and connected to the bottom end of the air inlet hole 52 of the water tank, for preventing the outside air from entering into the air inlet hole 52 of the water tank to result in incomplete water stoppage after the air is closed when the mopping cloth of the mopping module is wet.

In some embodiments, the mopping cloth of the mopping module is bonded to the bottom of the water tank body through a Velcro, and the Velcro is a sticker made of a square double-sided adhesive material.

In some embodiments, the air inlet hole 52 of the water tank and the mopping cloth of the mopping module are in contact with each other.

In some embodiments, the mopping cloth of the mopping module is made of a water absorbent textile.

In some embodiments, the mopping cloth of the mopping module may be made of a textile which readily absorbs water, and the bottom of the water tank body is bonded and connected to the mopping cloth of the mopping module through a Velcro. Based on the above connection means, the position of the air inlet hole 52 of the water tank at which air enters, that is, the bottom end of the air inlet hole 52 of the water tank, has a close attachment relationship with the above-mentioned mopping cloth of the mopping module made of the water absorbent textile, and then when the water absorbent textile expands after absorbing water, the position of the air inlet hole 52 of the water tank at which air enters is closed, so to achieve the technical effect of water stoppage.

In addition, according to an implementation method of the embodiments of the present disclosure, when a knob switch of the water amount control module is in a large water operating position or in a small water operating position, the add-on type mopping module is still and laid flat on the ground, and thus the prerequisite is that the mopping module is still and laid flat. When the user forgets to turn off the knob, the water outlet hole 54 will continuously discharge water, and if the water tank discharges water, air needs to be provided from the outside to ensure that the air pressure of the water tank is consistent with the external air pressure. When the water discharged from the water tank is large enough and wets the mopping cloth, the water in the mopping cloth will naturally close and seal the air inlet hole 52, so that the water tank cannot be supplied with air pressure difference, and thus the water tank body stops discharging water in a certain period of time. Therefore, the water stop function is realized when the add-on type mopping module is laid flat. In addition, according to the water shrinkage and water absorption of the mopping cloth, it is ensured that the water will not overflow onto the periphery of the mopping cloth during discharge of water from the water tank body, and it will not cause ground pollution.

In addition, when the mopping module is not used, the user may block the water outlet hole 54 when hanging the mopping cloth through the function of the horizontal water stoppage and the air inlet hole 52, so as to limit the continuous outflow of water in the water tank.

In some embodiments, at least one air inlet hole 52 is protruded from the lower outer surface of the water tank lower-case 12. The air inlet hole 52 extends non-communicatively through the water tank bottom-cover 13 and is in contact with the upper surface of the mopping cloth 18. There is a plurality of air inlet holes 52, and the plurality of air inlet holes 52 is communicated with the air inlet pipeline through a triangular section channel, or the air inlet holes 52 are respectively communicated with the air inlet pipeline, which will not be described in further detail here.

A plurality of through water tank holes 15 is provided at a position of the lower surface of the water tank lower-case 12 corresponding to the water amount control mechanism. The water outlet holes 54 are evenly distributed along a horizontal main path of the water passing channel 53; the air inlet holes 52 are evenly distributed along another horizontal main path of the water passing channel 53; or the air inlet holes 52 and the water outlet holes 54 are located at the same horizontal position along the horizontal main paths of the water passing channel 53. The horizontal positions of both the air inlet holes 52 and the water outlet holes 54 are higher than a horizontal position of the water tank holes 15 of the water tank lower-case 12.

Through the above steps, the technical effect of automatic water stoppage when the mopping module is laid flat may be achieved. Meanwhile, when the mopping cloth is short of water, the mopping cloth may be infiltrated with a structure such as the water outlet hole 54, so as to achieve the technical effect that the ground may be cleaned at any time.

According to an aspect of the embodiments of the present disclosure, there is provided a mopping module, including: an air inlet pipeline 51 and a water tank 10. The air inlet pipeline 51 is provided inside the water tank 10. The air inlet pipeline extends upwardly from the bottom of the water tank to be adjacent to a top surface of the water tank. The air inlet pipeline 51 includes a body having a first end portion and a second end portion, and an airway channel located in the body and extending from the first end portion to the second end portion. The first end portion has an air inlet hole 52, and the second end portion has an air outlet hole 57. The first end portion is fixedly connected to the bottom of the water tank 10, and the second end portion is adjacent to an inner upper surface of the water tank 10 in a non-contact manner.

The first end portion of the air inlet pipeline 51 is non-communicatively penetrated through a lower-case of the water tank 10. An end surface of the first end portion is adjacent to an upper surface of the mopping cloth 18. The air inlet hole 52 is provided on the end surface of the first end portion.

An accommodating portion 56 is provided at a position of the inner upper surface of the water tank 10 corresponding to the air inlet pipeline 51. The second end portion of the air inlet pipeline 51 extends into the accommodating portion 56 in a non-contact manner to prevent water from overflowing from the second end portion. In particular, the accommodating portion extends downwardly along the inner upper surface of the water tank to be below an end surface of the second end portion of the air inlet pipeline, which further prevents water from overflowing from the second end portion.

The accommodating portion 56 is composed of an annular protrusion surrounding the second end portion of the air inlet pipeline 51 and/or a groove in the inner upper surface of the water tank 10, and the second end portion of the air inlet pipeline 51 is in clearance fit with the annular protrusion and/or the groove.

The end surface of the second end portion of the air inlet pipeline 51 is not in contact with a bottom surface of the accommodating portion 56, so that the air may enter the water tank.

A distance of less than 1 mm is maintained between the end surface of the second end of the air inlet pipeline 51 and the bottom surface of the accommodating portion 56. This distance allows the air introduced through the air inlet hole 52 to flow to the water tank body through the air passage. The gap is a communication passage for circulating the air in the air passage and in the water tank body, so that the internal and external air pressures are the same.

A distance of 0.5 mm is maintained between the end surface of the second end portion of the air inlet pipeline 51 and the bottom surface of the accommodating portion 56.

An opening groove 55 is provided on the second end portion of the air inlet pipeline 51, and a depth of the opening groove 55 is less than that of the accommodating portion 56.

The opening groove 55 is cross-shaped, or is provided in the form of symmetrical notches, or is provided in a saw teeth shape, which is used to increase the area for the air entering into the water tank main body, and meanwhile to prevent impurities in the water in the water tank main body from blocking the air inlet pipeline 51 or to prevent the air inlet hole 52 from forming a water film.

There is a columnar, arc, or spiral airway channel between the first end portion and the second end portion of the air inlet pipeline 51, which can reduce the sloshing of the water in the water tank to flow out of the water tank.

The air outlet hole is a cone-shaped hole, and a smaller end of the cone-shaped hole is located on the end surface of the second end portion of the air inlet pipeline, which can reduce the sloshing of the water in the water tank to flow out of the water tank.

The air inlet hole 52 is a step-shaped hole or a cone-shaped hole, a smaller end of the step-shaped hole or the cone-shaped hole is provided on the end surface of the first end portion of the air inlet pipeline 51. The air inlet hole 52 is a perfect circular hole with a minimum radius of lcm. The small end is provided on the end surface of the first end portion of the air inlet pipeline 51, which can reduce impurities which enter into the water tank.

In some embodiments, in order to determine the dryness or wetness of the mopping cloth of the mopping module more accurately through the air inlet holes, there may be provided a plurality of air inlet holes, and meanwhile the plurality of air inlet holes is evenly distributed at the bottom of the water tank body. After the mopping cloth is bonded at the bottom of the water tank body, all of the air inlet holes will be closed and open based on the dryness or wetness of the mop. Therefore, only when the mopping cloth is completely wet, it is possible that all the air inlet holes are closed, so that the space in the water tank body is in a relatively vacuum state, and the water in the water tank body will not overflow onto the mopping cloth, so as to achieve a better effect of water stoppage.

According to another aspect of the embodiments of the present disclosure, there is provided a mopping module, including: an air inlet hole 52, a water outlet hole, a water passing channel 53, an air inlet pipeline 51, and a water tank 1. The water tank 1 is formed by a water tank upper-case 11, a water tank lower-case 12, a water tank bottom-cover 13 and a mopping cloth 18 which are sequentially connected from top to bottom. The air inlet pipeline 51 is provided in the water tank 1. A lower extending end at one end of the air inlet pipeline 51 is non-communicatively protruded through the water tank bottom-cover 13, and a lower extending end surface is provided with the air inlet hole 52 and is in contact with an upper surface of the mopping cloth 18. The other end of the air inlet pipeline 51 extends upwardly and protrudes into an interior of the water tank upper-case 11, and an upper extending end surface of the other end of the air inlet pipeline 51 is not in contact with an upper inner surface of the water tank upper-case 11. The air inlet pipeline 51 communicates the interior of the water tank main body and the mopping cloth 18.

The air inlet pipeline 51 is annular columnar, and one end of the air inlet pipeline 51 extends downwardly and protrudes from a lower surface of the water tank lower-case 12.

The water tank upper-case 11 and the water tank lower-case 12 are engaged to form a water tank main body. The water tank bottom-cover 13 is covered and detachably mounted on a lower outer surface of the water tank lower-case 12. The mopping cloth 18 is covered and detachably mounted on a lower surface of the water tank bottom-cover 13.

The water tank bottom-cover 13 is provided with at least one water outlet hole therethrough. At least one air inlet hole is protruded from the lower outer surface of the water tank lower-case 12, and a plurality of through water tank holes is provided at a position of the lower surface of the water tank lower-case 12 corresponding to the water amount control mechanism.

The lower outer surface of the water tank lower-case 12 is partially recessed upwardly to form a water passing groove, and a water passing channel 53 is formed between the water tank bottom-cover 13 and the water passing groove.

An upwardly recessed portion is provided at a position of the water tank upper-case 11 corresponding to the air inlet pipeline 51. An upper extending end at the other end of the air inlet pipeline 51 is inserted with a clearance fit into the recessed portion. An upper extending end surface of the other end of the air inlet pipeline 51 is not in contact with a bottom surface of the recessed portion of the water tank upper-case 11.

The mopping cloth 18 is made of a textile which readily absorbs water. A bottom end of the air inlet hole 52 is closely attached to the water absorbent textile of the mopping cloth 18, and the water absorbent textile expands after absorbing water and closes the air inlet hole 52.

In some embodiments, when the user uses the embodiments of the present disclosure, the water tank body is provided to store water for cleaning needed for the mopping cloth in the mopping module. And, an air inlet hole 52 of the water tank is provided through which air enters into the water tank to communicate an air pressure in the water tank body with an external atmospheric pressure, so that when the internal pressure is the same as the external pressure, the water in the water tank body automatically sinks into and infiltrates the mopping cloth of the mopping module only under the action of gravity. Therefore, when the air inlet hole 52 of the water tank is blocked by the wet mopping cloth, the air inlet hole 52 of the water tank cannot obtain the external atmospheric pressure, and thus the water in the water tank will not drop to the mopping cloth of the mopping module under the action of gravity, and the space in the water tank body will further be in a relatively vacuum state.

In some embodiments, the above-mentioned water tank body is configured to accommodate water for cleaning. The air inlet hole 52 of the water tank, as a key mechanism for determining whether the water for cleaning stops sinking into the mopping cloth of the mopping module, needs to form the upper communication structure with the air inlet hole 52 of the water tank. The upper communication structure may be a gap of not more than 1 mm, which is integrally recessed and formed during preparation of the water tank body, for avoiding damage to the mopping module when cleaning the ground. The gap between the air inlet hole 52 of the water tank and the water tank body of the upper communication structure is used to input the air introduced through the air inlet hole 52 of the water tank into the water tank body.

In addition, according to an implementation method of the embodiment of the present disclosure, with respect to some embodiments of the present disclosure, in order to achieve the purpose of transmitting and closing the air pressure to the water tank body, the air exhaust pipeline is communicated with the water tank body, and the air inlet hole is located between the mopping cloth and the bottom of the water tank body for directly contacting the mopping cloth and sucking in or closing the air based on the dryness or wetness of the mopping cloth, and then the air entering into the air inlet hole 52 and the air passage through the air inlet hole may also pass through the communication passage to the water tank body.

When the air inlet hole may suck in air, the air pressure in the water tank body is the same as the outside air pressure. At this point, the water in the water tank body may flow into the mopping cloth to wet the mopping cloth under the action of gravity. However, when the mopping cloth is fully wet, the air inlet hole will be blocked. Therefore, the air at the air inlet hole is closed, that is, no outside air is sucked in, and then the air in the air passage and in the water tank body will be in a relatively vacuum pressure state, and the water in the water tank body will no longer flow out under the action of gravity, that is, the water in the water tank body will be maintained in the water tank body based on suction and closure of the air, so as to achieve the technical effect of controllably releasing the water in the water tank.

In some embodiments of the present disclosure, the air outlet hole 57 is fitted with an inner upper surface of the water tank 10 in a non-contact manner, and thus the air may continuously enter into the water tank 10 through the air inlet hole 52, thereby providing a pressure difference for discharging the water from the water tank 10, so that the water in the water tank 10 is reliably released onto the mopping cloth 18.

Meanwhile, an accommodating portion 56 is provided at a position of the inner upper surface of the water tank 10 corresponding to the air inlet pipeline 51. The second end portion of the air inlet pipeline 51 extends into the accommodating portion 56 in a non-contact manner. In the state of maintaining the non-contact fit, the water in the water tank 10 is effectively prevented from flowing out of the water tank 10 through the air inlet pipeline 51 when the water in the water tank 10 sloshes.

Furthermore, the upper extending end surface of the other end of the air inlet pipeline 51 is provided with an opening groove 55, which increases the area for the air entering into the main body of the water tank 10, and meanwhile prevents impurities in the water in the main body of the water tank 10 from blocking the air inlet pipeline 51 or prevents the air inlet hole 52 from forming a water film.

Figure 8:
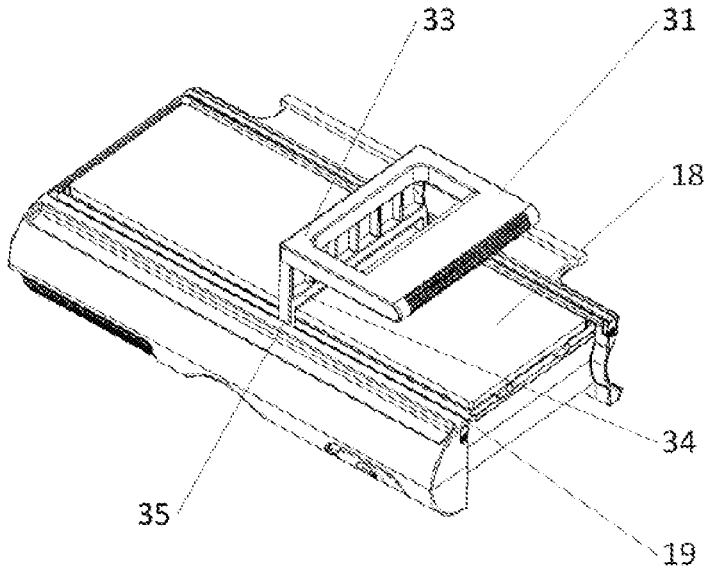
FIG. 8 is a schematic structural diagram of a mopping cloth cleaning device in FIG. 1 in which the handle is rotated to the side of the mopping cloth.
Figure 9:
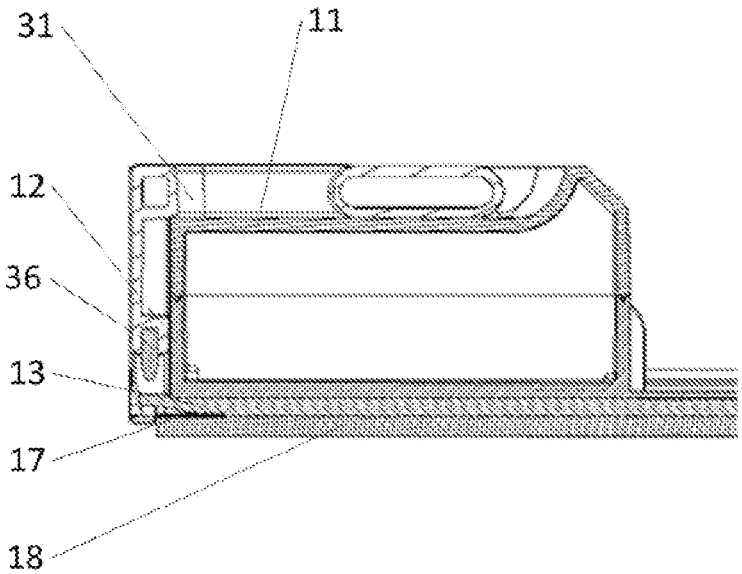
FIG. 9 is a schematic partial enlarged structural diagram of the left portion in FIG. 3.
Figure 10:
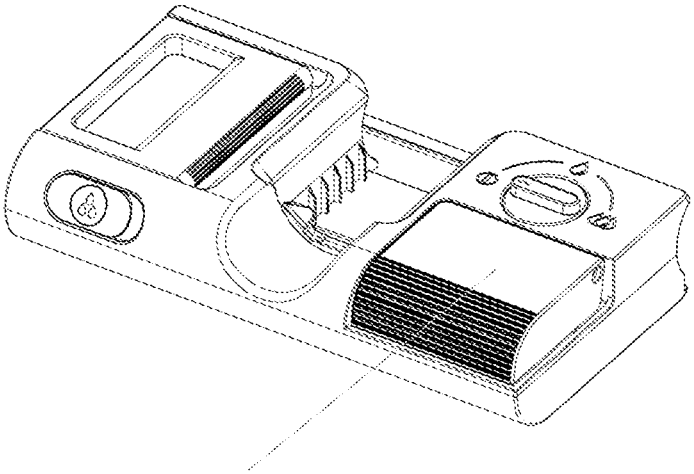
FIG. 10 is a schematic structural diagram of the mopping module in FIG. 1 before the pedal is depressed.
Figure 11:
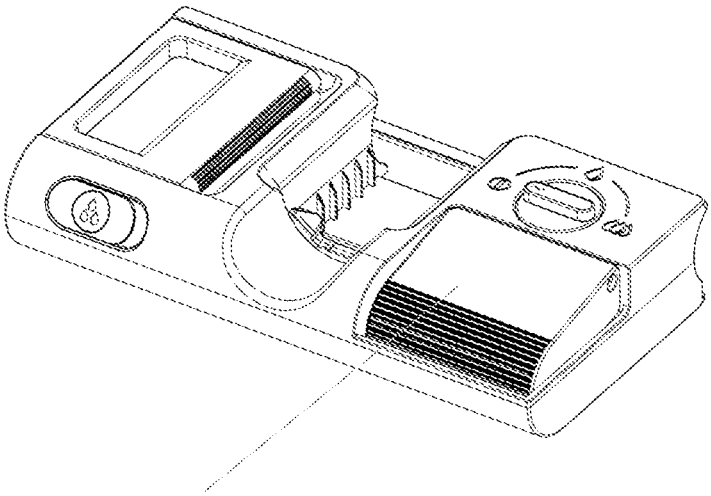
FIG. 11 is a schematic structural diagram of the mopping module in FIG. 1 after the pedal is depressed.
Figure 12:
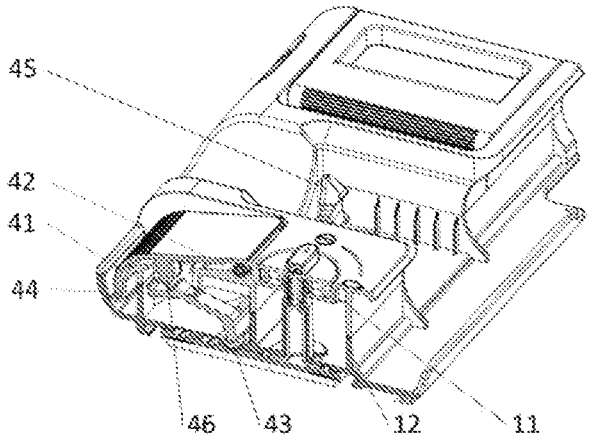
FIG. 12 is a schematic cross-sectional structural diagram of the position where the mopping module in FIG. 1 is depressed.
Figure 13:
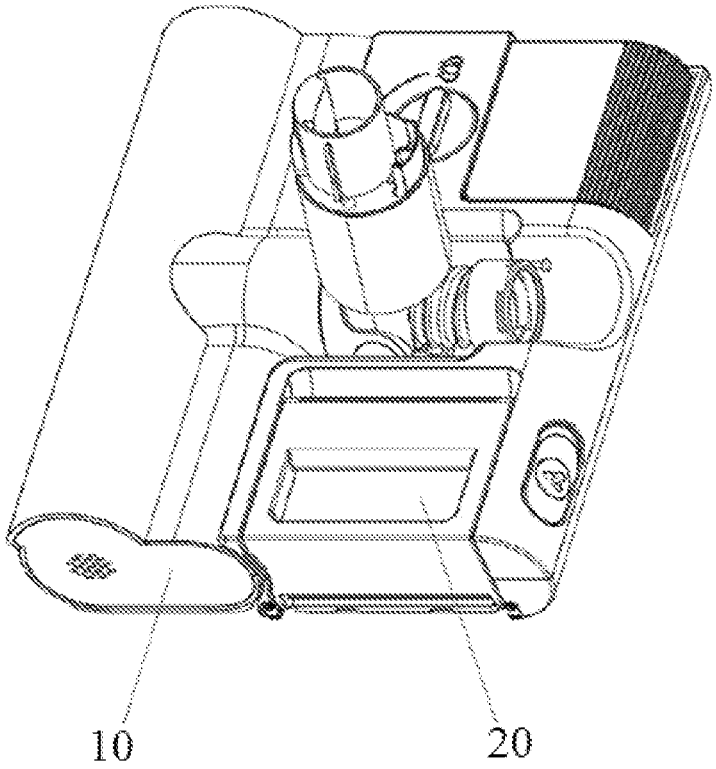
FIG. 13 is a schematic three-dimensional structural diagram of a cleaning head according to an embodiment of the present disclosure.
Figure 14:
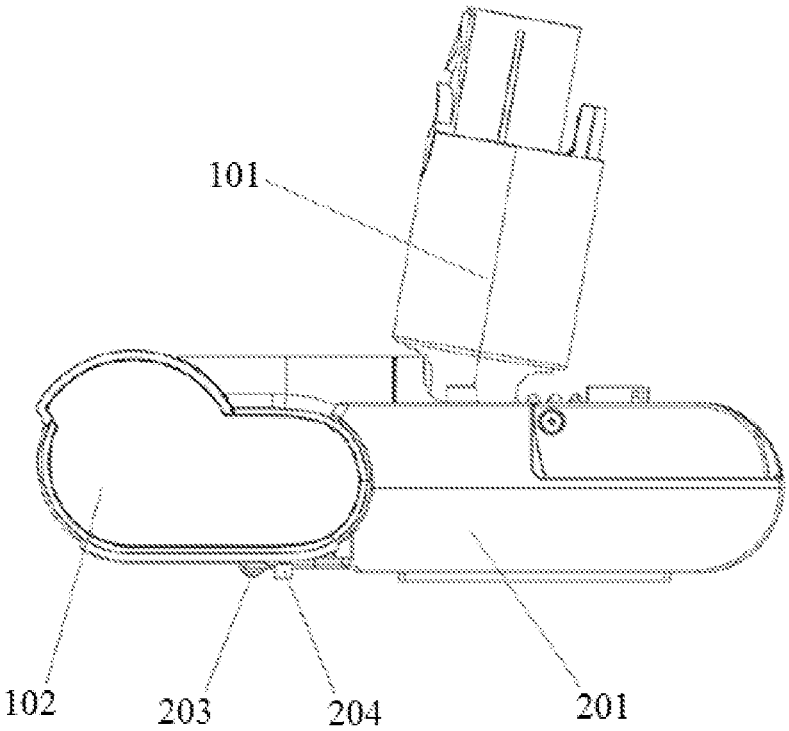
FIG. 14 is a schematic side structural diagram of FIG. 13.
Figure 15:
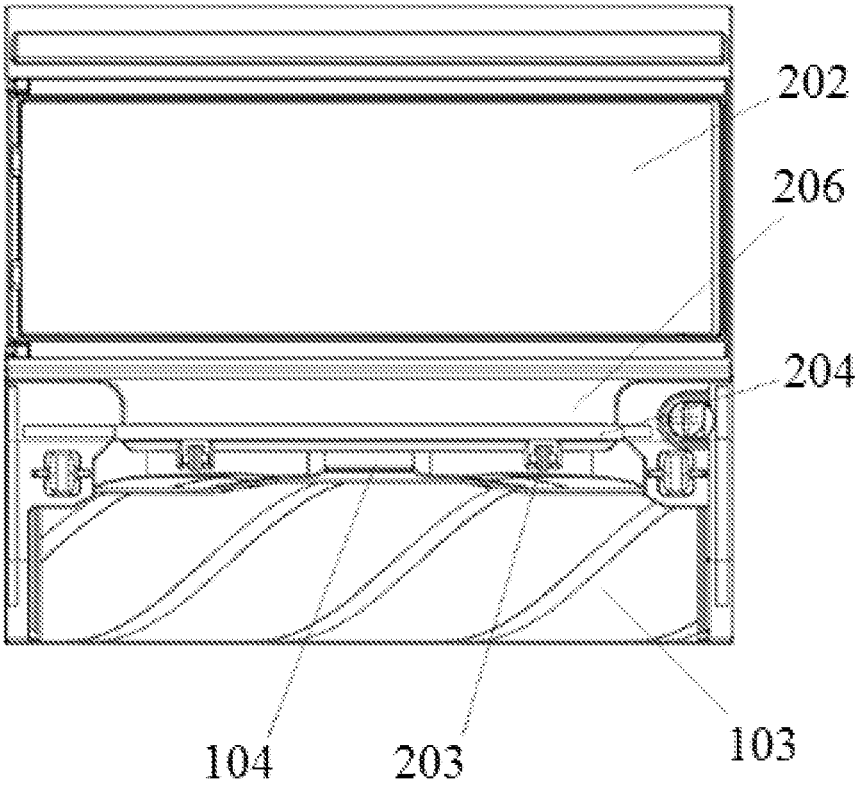
FIG. 15 is a schematic top structural diagram of FIG. 13.
Figure 16:
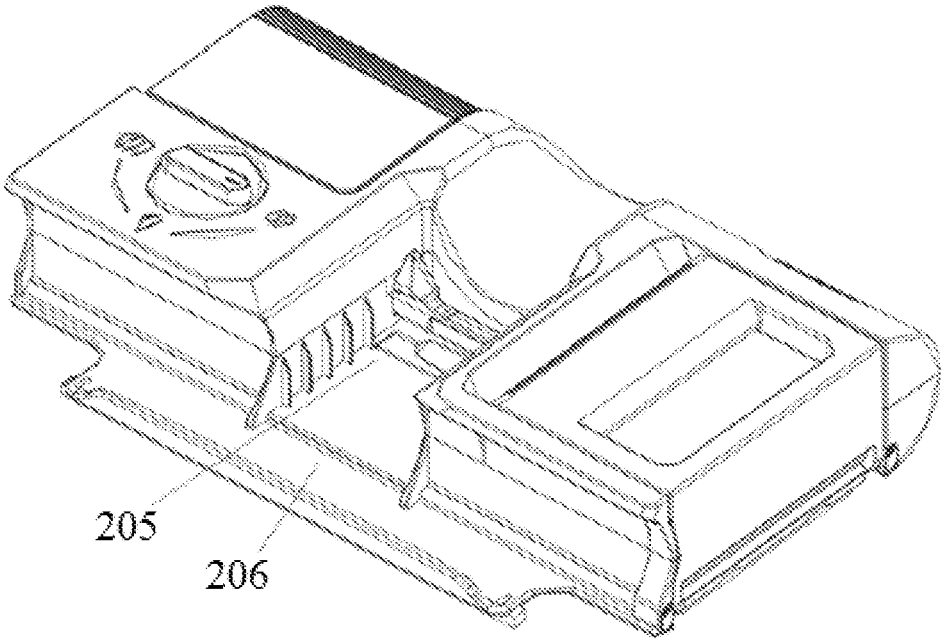
FIG. 16 is a schematic three-dimensional structural diagram of FIG. 13 after a vacuum cleaner module is removed.

Referring to FIG. 8 to FIG. 9, according to some embodiments of the present disclosure, there is provided a mopping cloth cleaning device, including: a handle 31, a scraping blade 36, and a sliding leg 35. The handle 31 is provided on a first plate body 33. The scraping blade 36 is provided on a second plate body 34. The first plate body 33 and the second plate body 34 intersect with each other to form an L configuration. The handle 31 and the scraping blade 36 are respectively located at the distal ends of the L configuration where the first plate body 33 and the second plate body 34 do not intersect with each other. The sliding leg 35 is located on the second plate body 34.

Further, the scraping blade 36 is a rigid rubber strip embedded and mounted at the distal end of the second plate body 34.

Further, the scraping blade 36 is made of the same material as that of the second plate body 34, and the scraping blade 36 and the second plate body 34 are integrally formed.

Further, the sliding leg 35 is located within a plane where the second plate body 34 is located, and are located at both ends of the scraping blade 36 in the length direction.

Further, the second plate body 34 intersects with the first plate body 33 perpendicularly.

Further, the scraping blade 36 is provided with several concave-convex stripes.

Furthermore, the present disclosure further provides a clean water tank, including a water tank, a mopping cloth mounting plate provided at the bottom of the water tank, and a mopping cloth, and including the mopping cloth cleaning device described above.

Further, a sliding chute is provided on the mopping cloth mounting plate for cooperating with the sliding leg 35 so that the mopping cloth cleaning device may slide along a direction of the length of the mopping cloth.

Further, a stop rubber plug is provided at one end of the sliding chute away from the second plate body 34, and the stop rubber plug is fixed within the sliding chute to block the sliding leg 35.

Further, a hand-grip groove 32 is provided on the top of the water tank, and the hand-grip groove 32 is integrally formed in the middle of the upper outer surface of the water tank upper-case.

According to some embodiments of the present disclosure, there is provided a water tank, including: a handle 31, a hand-grip groove 32, and a water tank. The water tank includes a water tank upper-case 11, a water tank lower-case 12, a water tank bottom-cover 13, and a mopping cloth 18. The water tank upper-case 11 and the water tank lower-case 12 are engaged and sealingly connected to form a hollow water tank main body. The water tank bottom-cover 13 is covered and mounted on a lower outer surface of the water tank lower-case 12. The mopping cloth 18 is covered and detachably mounted on a lower surface of the water tank bottom-cover 13. The handle 31 may be engaged and provided within an upper outer surface of the water tank upper-case 11. The handle 31 may slide along a lower surface of the mopping cloth 18 in a contact manner.

The handle 31 is formed into an L shape by a first plate body 33 and a second plate body 34 which are perpendicular to each other, and a sliding leg 35 is provided at each end of one side of the second plate body 34 away from the first plate body 33. The first plate body 33 is provided with a handle groove for a hand-grip operation, and the second plate body 34 is provided with a reinforcing rib for improving the strength of a scraper of the handle 31.

When the handle 31 is engaged within the upper outer surface of the water tank upper-case 11, a plane where the first plate body 33 is located is parallel to a plane where the water tank upper-case 11 is located, and a plane where the second plate body 34 is located is perpendicular to the plane where the water tank upper-case 11 is located.

When the handle 31 slides along the lower surface of the mopping cloth 18, the scraping blade 36 at one end of the second plate body 34 is in interference contact with the mopping cloth 18, so as to scrape and clean the mopping cloth.

The scraping blade 36 is machined with several concave-convex stripes for increasing a sliding friction force of the second plate body 34 and improving the effect of scraping and cleaning the mopping cloth.

The handle 31 may rotate around the sliding leg 35 of the first plate body 33 as the axis. During the rotating operation, the handle 31 disengages from the accommodating groove for the handle 31 and rotates to a side of the lower outer surface of the water tank lower-case 12.

An accommodating groove for the handle 31 is provided on one side of the upper outer surface of the water tank upper-case 11. The handle 31 may be engaged and arranged in the accommodating groove for the handle 31. The accommodating groove for the handle 31 is open on one side, and the handle 31 disengages from the accommodating groove for the handle 31 along the opening direction. The accommodating groove for the handle 31 matches the shape of the first plate body 33 of the handle 31.

A sliding chute 19 is provided on both sides of the lower outer surface of the water tank lower-case 12 along the length direction. A slidable portion of the sliding leg 35 is provided within the sliding chute 19.

As shown in FIG. 8 to FIG. 9, a scraping blade 36 is provided at one end of the sliding leg 35 away from the second plate body 34. The first plate body 33 and the second plate body 34 are moved by the handle 31. The sliding leg 35 of the second plate body 34 slides within the sliding chute. The scraping blade 36 is in interference contact with the mopping cloth 18. Different types of mopping clothes may be scraped by means of applying different pressing forces by the handle 31; and meanwhile, during the dehydration process of the mopping cloth, the size of the mopping cloth will also be reduced. The scraping pressure applied on the mopping cloth 18 by the scraping blade 36 may be dynamically adjusted by means of applying a pressing force, so as to achieve sufficient dehydration.

The sliding leg 35 of the second plate body 34 may slide back and forth along a penetrating direction of the sliding chute 19. In order to prevent the handle 31 from disengaging from the water tank main body, a stop rubber plug is provided at one end of the sliding chute 19 away from the accommodating groove for the handle 31. The stop rubber plug has a rectangular parallelepiped shape, and one side thereof is fixedly adhered into the sliding chute 19 to prevent the sliding leg 35 of the handle 31 from sliding out of the sliding chute 19.

The hand-grip groove 32 is provided on one side of the water tank upper-case 11 for grasping the mopping cloth assembly more firmly by the user. The above-mentioned hand-grip groove 32 may be machined to be recessed downwardly or to be annular handle-shaped, and the specific machining mode is not limited here, as long as it is ensured that the purpose of the hand-grip groove 32 is to grasp more firmly, for grasping the water tank main body.

The hand-grip groove 32 may be a groove-type component made of the same material as that of a functional panel, which is connected to the water tank by gluing or engaging. When the user needs to clean the mopping cloth, it is necessary to firmly hold the entire mopping module by hand, and at this point, the user may grasp the groove portion by hand based on the setting of the hand-grip groove 32, so as to achieve the technical effect of firmly grasping the mopping module.

Preferably, the hand-grip groove 32 is integrally formed in the middle of the upper outer surface of the water tank upper-case 11, and an arc-shaped recessed portion of the hand-grip groove 32 is embedded on the functional panel on the front of the mopping cloth.

The mopping cloth may be made of a common textile used for cleaning the ground, and is fixed in a case by a fixing device, so that when the user uses the mopping cloth assembly to clean the ground, the mopping cloth assembly may clean the dust or garbage on the ground.

The case may be made of metal or environmentally friendly hard plastic material, and the mopping cloth assembly is fixed in the case by the fixing device to form an integral ground mopping device.

FIG. 9 is a schematic view of the rotation of the handle 31 of a mopping cloth cleaning device according to an embodiment of the present disclosure. The handle 31 may be a pull-rod drawable handle 31 made of environmentally friendly hard plastic, which is usually retracted into the water tank when not in use, and the handle 31 is drawn out when the user needs to use the handle 31 for cleaning the mopping cloth, so that the handle 31 may be operated so as to achieve the technical effect of cleaning the mopping cloth.

In some embodiments, in order to clean the mopping cloth of the mopping module by the handle 31, the handle 31 may be designed to be drawable, that is, a drawable component is provided on the handle 31 for pulling the handle 31 out of the mopping cloth, the user may pull out and retract the handle 31 by pulling or pushing hard after grasping the handle 31.

In some embodiments, in the embodiments of the present disclosure, after pulling or pushing the handle 31, the user needs to rotate the handle 31 to make the handle 31 be in a working state. The mopping cloth may be cleaned when the handle 31 is in the working state, and the handle 31 is in a state in which the user may use the handle 31. In this state, the user only needs to operate the handle 31 according to the following method to achieve the technical purpose of quickly cleaning the mopping cloth.

Figure 2:
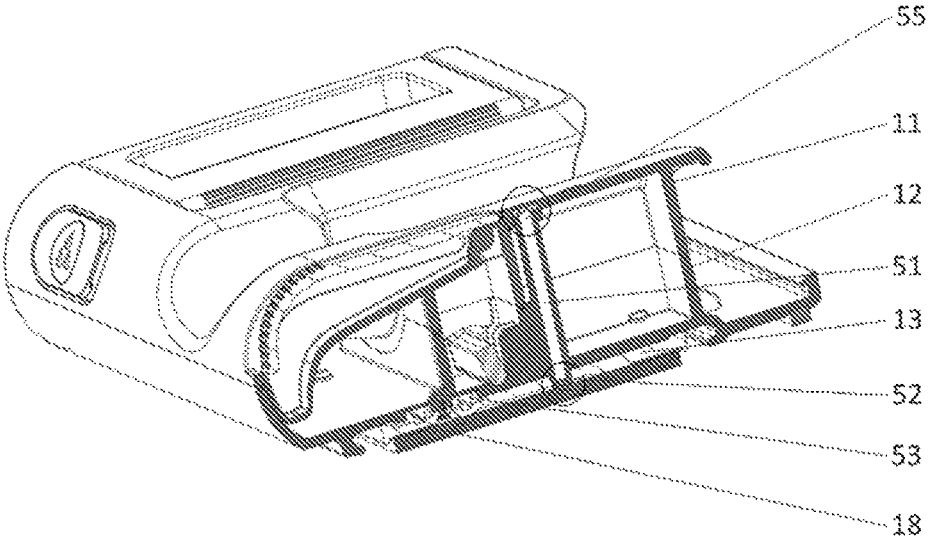
FIG. 2 is a schematic cross-sectional structural diagram at the water tank in FIG. 1.
Figure 3:
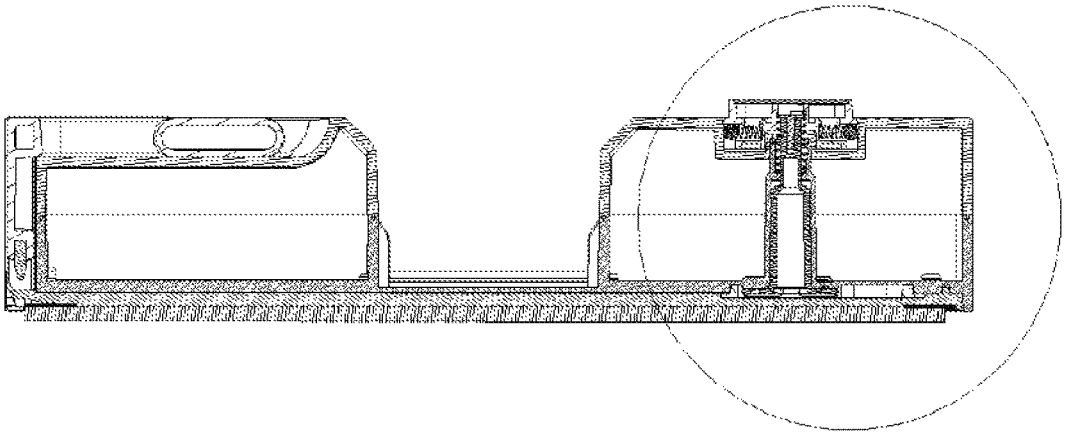
FIG. 3 is a schematic full-sectional structural diagram of the mopping module in FIG. 1.
Figure 4:
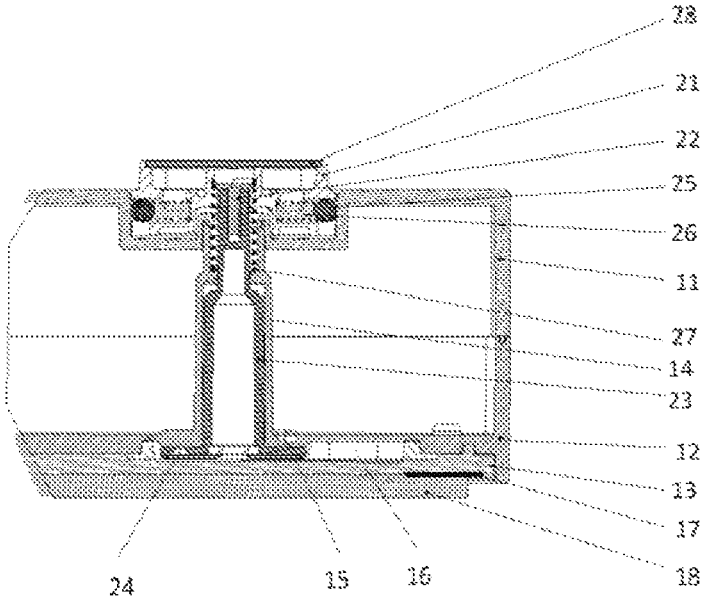
FIG. 4 is a schematic partial enlarged structural diagram of the circled area in FIG. 3.
Figure 5:
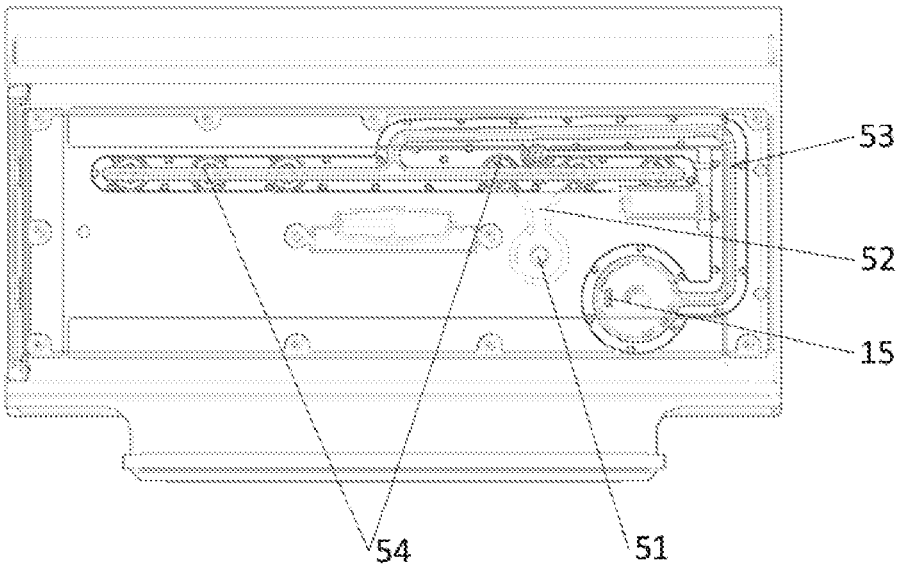
FIG. 5 is a schematic structural diagram of a bottom of the mopping module in FIG. 1.
Figure 6:
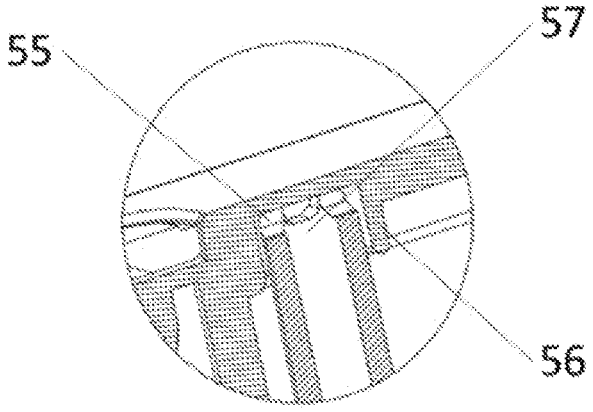
FIG. 6 is a schematic partial enlarged structural diagram of the upper circled area in FIG. 2.
Figure 7:
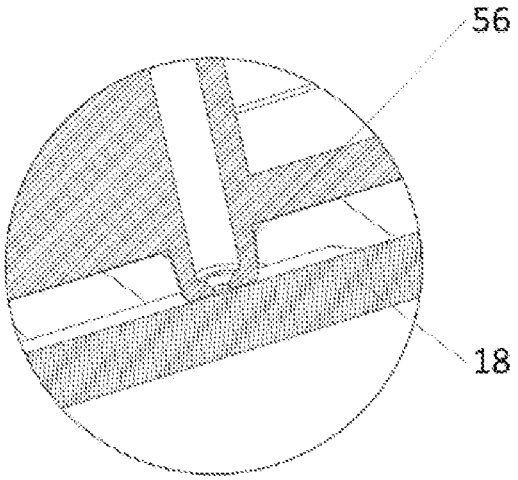
FIG. 7 is a schematic partial enlarged structural diagram of the lower circled area in FIG. 2.

In some embodiments, after rotating the handle 31, the user may slide the handle 31 along the penetrating direction of the sliding chute 19 of the water tank lower-case 12. As shown in FIG. 2, the user needs to hold a grip of the handle 31 and slide the handle 31 back and forth along an arrangement direction of the sliding chute 19, the technical effect of fully cleaning the mopping cloth may be achieved by squeezing the mopping cloth body in the water tank back and forth. The mopping cloth in the mopping module may be made of a textile with a certain toughness.

In some embodiments, in order to avoid unnecessary over-force damage or to avoid sliding out of the sliding chute 19 when the user uses the handle 31 to slide along the sliding chute 19, a stop rubber plug is provided on one side of the sliding chute 19 for being forced to soft-stop when the handle 31 is slid to a certain position by the user, so as to inform the user that this position is a limit position and it is not suitable to continue to push the handle 31 hard.

During the use of the embodiment of the present disclosure, the mopping cloth cleaning device is taken out of the water tank by one hand, and the hand-grip groove 32 of the mopping cloth cleaning device is held by the other hand. The mopping cloth is located on the underside of the water tank lower-case 12, and with turning the handle 31 over by 180°, the handle 31 moves back and forth along the sliding chute 19 of the water tank. The handle 31 is designed with a scraping blade 36 for maintaining a surface contact. The second plate body 34 may be moved toward the mopping cloth 18 by means of compressing the scraping blade 36 by the sliding leg 35, thereby dynamically adjusting the distance between the side of the second plate body 34 in contact with the lower surface of the mopping cloth 18 and the mopping cloth 18 for different types of mopping cloth, so that the mopping cloth may be fully dehydrated, thereby achieving the function of cleaning the mopping cloth without hands.

In addition, in order to control the positive movement of the handle 31 along the track, a stop rubber plug is provided within the sliding chute 19.

Through the above steps, it is possible to conveniently and quickly clean the mopping cloth in the water tank.

According to another aspect of the embodiments of the present disclosure, there is provided a mopping module. The mopping module includes the above-mentioned mopping cloth cleaning device. The mopping module further includes a water tank 1, a water amount control knob assembly 2, a pedal linkage assembly 4, and a water stop assembly 5. The mopping cloth cleaning device is provided at one end of an upper portion of the water tank 1. The water amount control knob assembly 2 and the pedal linkage assembly 4 are symmetrically provided on both sides of the other end of the water tank 1. The water stop assembly 5 is communicated with the water tank 1.

The water tank includes a water tank upper-case 11, a water tank lower-case 12, a water tank bottom-cover 13, a water tank Velcro 17, and a mopping cloth 18. The edges of the water tank upper-case 11 extend downwardly, and the edges of the water tank lower-case 12 extend upwardly. The water tank upper-case 11 and the water tank lower-case 12 are engaged and sealingly connected through the edges thereof to form a hollow water tank main body. The water tank bottom-cover 13 is covered and detachably mounted on a lower outer surface of the water tank lower-case 12. The mopping cloth 18 is covered and detachably mounted on a lower surface of the water tank bottom-cover 13 through the water tank Velcro 17.

The water tank main body is used for water storage, and thus the water tank upper-case and the water tank lower-case are connected rigidly and water-tightly, and the seam between them may be formed by bonding or by hot pressing, and which connection manner is adopted is not In some embodiments limited here.

Based on the same inventive concept, referring to FIG. 10 to FIG. 16, the embodiments of the present disclosure further provide a cleaning head, the cleaning head may include a mopping module and a vacuum cleaner module. The mopping module is any of the mopping module described above. The vacuum cleaner module and the mopping module can be detachably engaged to combine into one piece. The vacuum cleaner module is engaged and mounted through a mounting portion provided on the mopping module, and when the vacuum cleaner module and the mopping module are engaged, a bottom surface of the mopping module is in contact with a ground to be cleaned, and a bottom surface of the vacuum cleaner module is separated from the ground to be cleaned.

FIG. 10 to FIG. 16 are alternative embodiments of the present disclosure. According to some embodiments of the present disclosure, there is provided a cleaning head, including a mopping module and a mounting portion, and the mounting portion is configured to be connected to a brush head of the vacuum cleaner module. The mounting portion includes a locking shaft 43 and a locking portion 45. The locking portion 45 moves between a first state in which the locking portion 45 locks the brush head and a second state in which the locking portion 45 rotates around the locking shaft 43 so as to unlock the brush head.

The locking portion 45 is provided at one end of the mounting portion, and a linkage portion 44 is further provided at the other end of the mounting portion, the locking portion 45 may move from the first state to the second state by the linkage portion 44.

A first reset device is further provided on the mounting portion, and the first reset device may reset the locking portion 45 from the second state to the first state.

The water tank further includes a pedal 41 provided on an upper surface of the water tank. The pedal 41 is provided with a pedal inner protrusion 46 that interacts with the linkage portion 44, and the pedal inner protrusion 46 drives the linkage portion 44 to move through the movement of the pedal 41, so that the locking portion 45 moves from the first state to the second state.

The pedal 41 has a rotating shaft 42 and a second reset device, the pedal 41 may move from a third state to a fourth state when depressed, and the second reset device may reset the pedal 41 from the fourth state to the third state; the third state corresponds to the first state, and the fourth state corresponds to the second state.

The first and/or second reset device is a torsion spring, which is respectively provided on the locking shaft 43 and/or the rotating shaft 42.

A cooperating space for cooperating with the brush head is provided on the water tank, and the locking portion 45 is arranged in the cooperating space, and the locking portion 45 is one or more engagement protrusions combined with the brush head.

A joint portion of the linkage portion 44 and the pedal inner protrusion 46 is a smooth surface, and limiting protrusions are provided on both ends of the smooth surface. The pedal inner protrusion 46 may slide between the limiting protrusions. A stroke of the pedal inner protrusion 46 sliding between the limiting protrusions is less than or equal to a length of the smooth surface, corresponds to a stroke of the locking portion 45 between the first state and the second state, and also corresponds to a stroke of the pedal 41 between the third state and the fourth state.

Both ends of the locking shaft 43 of the mounting portion extend into the holes for the locking shaft 43 which are provided on the water tank.

Both ends of the rotating shaft 42 of the pedal 41 extend into the holes for the rotating shaft 42 which are provided on the water tank.

The water tank is further provided with a pedal limiting groove, and the limiting groove is provided on the upper surface of the water tank to have a shape matched with the edges of the pedal 41 for limiting the stroke of the pedal 41 in the fourth state.

According to some embodiments of the present disclosure, the mopping module includes: a pedal 41, a rotating shaft 42, a locking shaft 43, a linkage portion 44, a locking portion 45, a pedal inner protrusion 46, and a water tank 1. The water tank 1 includes a water tank upper-case 11 and a water tank lower-case 12. The water tank upper-case 11 and the water tank lower-case 12 are engaged and sealingly connected to form a hollow water tank main body. The water tank upper-case 11 and the water tank lower-case 12 are correspondingly provided with a notch for accommodating the water tank. The locking shaft 43 is contacted with the pedal 41 through a rigid contact to from a linkage connection, and a moving direction of the pedal 41 is opposite to a locking direction of the locking shaft 43.

The pedal 41 is hingedly provided on an upper outer surface of the water tank upper-case 11 through the rotating shaft 42, and the locking shaft 43 is hingedly provided on an upper outer surface of the water tank lower-case 12.

The water amount control knob assembly 2 and the pedal linkage assembly 4 are symmetrically provided on both sides of one end of the water tank 1. The locking shaft 43 is hingedly provided between the water amount control knob assembly 2 and the pedal linkage assembly 4. A shaft axis of the locking shaft 43 is parallel to that of the rotating shaft 42.

The rotating shaft 42 is provided on an upper extending portion of the water tank upper-case 11 facing the water tank, and the locking shaft 43 is hingedly provided on a lower extending portion of the water tank lower-case 12 facing the water tank. The lower extending portion and the lower surface of the water tank lower-case 12 are closed to form a complete rectangle, and the lower extending portion is matched with a shape of the pedal 41 correspondingly.

A linkage portion 44 is integrally extended from one end of the locking shaft 43 toward the pedal 41, and a locking portion 45 is integrally extended from the other end of the locking shaft 43 away from the pedal 41. The included angle between an extending direction of the linkage portion 44 and an extending direction of the locking portion 45 is θ, where $90° \leq \theta < 180°$.

Preferably, the included angle between the extending direction of the linkage portion 44 and the extending direction of the locking portion 45 is $120° < \theta < 150°$.

A pedal inner protrusion 46 is integrally extended from a lower surface of the pedal 41. The surface of the linkage portion 44 of the locking shaft 43 facing the pedal 41 is provided with two limiting protrusions. The pedal inner protrusion 46 cooperates with the two limiting protrusions to limit a depressed position and a reset position of the pedal 41.

The surface of the locking portion 45 of the locking shaft 43 away from the pedal 41 is provided with a locking protrusion. A connecting rod of the mopping module has a locking groove, and the locking protrusion may be inserted into the locking groove to fix the mopping module to the connecting rod.

An extended end of the locking portion 45 is tapered, which is convenient for guiding the locking protrusion of the locking portion 45 to be inserted into the locking groove of the connecting rod of the mopping module.

A hinged portion between the rotating shaft 42 and the water tank upper-case 11 is sleeved with an upper reset spring, and the upper reset spring provides a restoring force to make the pedal 41 go upward. A hinged portion between the locking shaft 43 and the water tank lower-case 12 is sleeved with a lower reset spring, and the lower reset spring provides a restoring force to make the linkage portion 44 of the locking shaft 43 go upward and make the locking portion 45 go downward.

The pedal 41 is provided with anti-sliding grooves which are arranged laterally. The anti-sliding grooves are arranged in a manner of arithmetic progression on the upper surface of the pedal 41.

In some embodiments, the pedal 41 of the water tank according to the embodiment of the present disclosure is used to provide a position to be depressed for the user. The user may unlock the mopping module by depressing the pedal 41, which is convenient for the user to remove and mount the mopping module. The locking shaft 43 and the rotating shaft 42 may be made of wear-resistant metal material, and are used to displace and lock the pedal 41 when the user uses the pedal 41.

Both sides of the rotating shaft 42 are machined with concave positioning grooves respectively, and a torsion spring for the rotating shaft 42 is mounted on the concave positioning groove for performing a return operation when the rotating shaft 42 twists.

Both sides of the locking shaft 43 are machined with concave positioning grooves respectively, and a torsion spring for the locking shaft 43 is mounted on the concave positioning groove for performing a return operation when the locking shaft 43 twists.

When the user depresses the pedal, the pedal 41 drives the rotating shaft 42 to rotate, and then in order to return the pedal 41, it is necessary to mount the torsion spring for the rotating shaft 42 on the rotating shaft 42, and the function of the torsion spring may be to automatically return the pedal by generating a reverse torque.

An upper side surface of the locking shaft 43 is in contact with a rigid protruding portion of the lower surface of the pedal 41 for linkage with the pedal 41. The protruding portion is a triangular protrusion, and an apex thereof serves as a contact point for contacting the limiting protrusion of the locking shaft 43. The rigid protrusion on the lower surface of the pedal 41 is the pedal inner protrusion 46, which cooperates with the two limiting protrusions to limit a depressed position and a reset position of the pedal 41.

In some embodiments, in order to achieve the disengaging and unlocking of the locking shaft 43 while the user depresses the pedal 41, a protrusion is provided under the pedal 41. The protrusion is rigidly connected to the pedal 41 itself, and is fixed on the mopping module through the case. As shown in section view of FIG. 3, the protrusion is in contact with the locking shaft 43, that is, when the protruding portion of the pedal 41 rotates under the external force of the pedal 41, the locking shaft 43 will be driven to rotate at the same time, so as to unlock the mopping module timely responding to the user's depressing.

In some embodiments, in the embodiments of the present disclosure, in order to avoid unsuccessful depressing of the user due to too small friction force when using the pedal 41, an anti-sliding groove is provided on the upper side of the pedal 41, that is, at a position where the user depresses the pedal 41. There may be several anti-sliding grooves, as long as the anti-sliding effect may be achieved, and thus the number of anti-sliding grooves is not limited here.

In addition, at the time of implementing the embodiment of the present disclosure, the user depresses the pedal 41 of the mopping module with the tiptoe, the pedal 41 moves downwardly, and the locking shaft 43 is driven to rotate counterclockwise. The locking shaft 43 is fixedly connected with the connecting rod of the mopping module by the protrusion of the locking portion 45. When the locking shaft 43 rotates counterclockwise, the mopping module disengages from the connecting rod, and otherwise the mopping module engages with the connecting rod more closely. A reset torsion spring is assembled on the locking shaft 43 and the rotating shaft 42 to facilitate the reset of the pedal 41 and the locking shaft 43.

In addition, for the entire mopping module, the embodiments of the present disclosure can realize the replacement and removal of the water tank 1 by depressing the pedal 41 in the process of using the mopping module by the user, without manual disengaging operation, which increases the convenience and operability for the user.

Through the above steps, it is possible to achieve the technical effect of conveniently and quickly unlocking and locking the mopping module.

FIG. 13 to FIG. 16 are alternative embodiments of the present disclosure. The vacuum cleaner module 10 and the mopping module 20 can be detachably engaged to combine into one piece. The vacuum cleaner module 10 is engaged and mounted through a mounting portion 205 provided on the mopping module 20, and when the vacuum cleaner module 10 and the mopping module 20 are engaged, a bottom surface of the mopping module 20 is in contact with a ground to be cleaned, and a bottom surface of the vacuum cleaner module 10 is separated from the ground to be cleaned.

The vacuum cleaner module 10 includes a vacuum cleaner housing 102, a rolling brush 103 accommodated within the vacuum cleaner housing, and a vacuum cleaner port 104.

The mopping module 20 includes a water tank 1, a mopping cloth 18, a supporting member, and a mounting portion 205. The mopping cloth 18 is covered and detachably mounted on a lower portion of a housing of the water tank 1. The mounting portion 205 is centrally provided on an upper portion of the housing of the water tank 1 in a left-right direction. A locking member is provided in the mounting portion 205, and the locking member can enable the vacuum cleaner module 10 to be engaged and fixed on the mopping module 20. A supporting plate 206 extends outwardly and integrally from a front end of a bottom case of the housing of the water tank 1. A supporting member is provided at a bottom of the supporting plate 206.

A height of the supporting member is less than a maximum thickness of the mopping cloth and is greater than a minimum thickness of the mopping cloth. A height of a bristle strip 204 or a protruding height of the rollers 203 is smaller than the maximum thickness of the mop, and the mopping cloth is the thickest when completely soaked. When the thickness of the mopping cloth is relatively larger, the mopping cloth itself can play the role of supporting the vacuum cleaner module 10 to be off the ground; and meanwhile, the height of the bristle strip 204 or the protruding height of the rollers 203 is greater than the minimum thickness of the mopping cloth. If the water tank 1 is short of water, the thickness of the mopping cloth will become thinner, and when the mopping cloth becomes thinner, the supporting member is used to support the vacuum cleaner module 10 to be off the ground.

The supporting member is the bristle strip 204 protruding from the bottom of the supporting plate 206, which may provide a certain support when the vacuum cleaner module is placed on a clean ground, and avoid complete deformation of the vacuum cleaner module due to the gravity of the vacuum cleaner module.

The bristle strip 204 is a continuous elongated member and water impermeable. The bristle strip 204 is inverted trapezoidal or rectangular along a length section. A length of the bristle strip 204 along the left-right direction is greater than ¾ of a length of the mopping cloth 18 along the left-right direction, and is less than or equal to the length of the mopping cloth 18 along the left-right direction.

The supporting member is one or more rollers 203 provided at the bottom of the supporting plate 206, and the roller 203 supports the vacuum cleaner module 10 to be off the ground.

The supporting member includes a bristle strip 204 and a roller 203. The bristle strip 204 is provided along the left-right direction, and the roller 203 is rotatably provided on one side of the bristle strip 204 along an operating direction of the vacuum cleaner module.

A bottom surface of the rolling brush 103 is the lowest surface of the vacuum cleaner module 10, and the bottom surface of the rolling brush 103 is always kept separated from the ground to be cleaned. The lowest surface of the vacuum cleaner module 10 is the bottom surface of the vacuum cleaner rolling brush 103. The vacuum cleaner rolling brush 103 is lifted off the ground to keep the vacuum cleaner module 10 to be off the ground, so as to avoid the rolling brush 103 to get wet when mopping the ground back and forth, which would make the ground get dirtier and dirtier.

The mopping cloth 18 is in contact with the ground to be cleaned. The supporting member has a first distance from the ground to be cleaned, the bottom surface of the vacuum cleaner module 10 has a second distance from the ground to be cleaned, and the second distance is greater than the first distance.

According to some embodiments of the present disclosure, there is provided a water tank combined by a vacuum cleaner module 10 and a mopping module 20 into one piece, which are detachably engaged, and a rear end of the vacuum cleaner module 10 is engaged with a front end of the mopping module 20 in a curved manner.

The vacuum cleaner module 10 includes a mopping rod 101, a vacuum cleaner housing 102, a rolling brush 103, and a vacuum cleaner port 104. A front side of a lower end of the mopping rod 101 is connected to the vacuum cleaner housing 102. A cavity with an open front side is formed inside the vacuum cleaner housing 102. A front end of the chamber is provided with a rolling brush 103 rotatable about the left-right direction, and a part of the surface of the rolling brush 103 faces outside the chamber. The vacuum cleaner port 104 is provided between the rolling brush 103 and the mopping rod 101 and is penetrated through the chamber. An upper portion of the vacuum cleaner port 104 is communicated with a vacuum cleaner channel in the mopping rod 101. A lower portion of the vacuum cleaner port 104 is communicated with the chamber of the vacuum cleaner housing 102. A rear side of the lower end of the mopping rod 101 is provided with a connecting portion of the mopping rod 101.

A rear end of the vacuum cleaner housing 102 has a first curved surface, a front end of the housing of the water tank 1 has a second curved surface, and the first curved surface is matched with the second curved surface.

Preferably, the first curved surface is an outer convex curved surface, and the second curved surface is an inner concave curved surface. A rotary shaft of the rolling brush 103 is provided in parallel along the left-right direction. After a period of use, the rolling brush 103 may be detached to remove fine dust such as electrostatic dust and foam particles which has been absorbed by rolling.

The rolling brush 103 includes a body of the rolling brush 103, a tufting material layer, and a rotary shaft. The tufting material layer surrounds and covers an outer surface of the body of the rolling brush 103. The rotary shaft is penetrated through the body of the rolling brush 103.

The mopping module 20 includes a water tank 1, a mopping cloth 18, a roller 203, and a bristle strip 204. The water tank 1 has a hollow housing of the water tank 1. The mopping cloth 18 is covered and detachably mounted on a lower portion of the housing of the water tank 1. A mounting portion 205 is integrally formed on a middle front end of the housing of the water tank 1 along the left-right direction. A connecting portion of the water tank 1 is provided in the mounting portion 205. A supporting plate 206 outwardly and integrally extends from a front end of a bottom case of the housing of the water tank 1. A bristle strip 204 and a roller 203 are provided at a bottom of the supporting plate 206. The supporting plate 206 extends and partially covers a lower chamber of the vacuum cleaner housing 102 and does not block the vacuum cleaner port 104.

The bristle strip 204 is provided along the left-right direction. The roller 203 is rotatably provided on one side of the bristle strip 204 along an operating direction of the vacuum cleaner module. Preferably, the roller 203 is provided on the side of the bristle strip 204 away from the mopping cloth 18, and the mounting portion 205 is partially open toward the front end. A length of the bristle strip 204 along the left-right direction is greater than ⅘ of a length of the mopping cloth 18 along the left-right direction, and is less than or equal to the length of the mopping cloth 18 along the left-right direction.

There are two rollers 203, which are symmetrically provided along the left-right direction.

The mopping cloth 18 is made of a textile which readily absorbs water, and the water absorbent textile of the mopping cloth 18 is closely attached to a ground to be cleaned.

A groove that runs through in a forward-backward direction is integrally formed on a middle rear end of the housing of the water tank 1 along the left-right direction. A bottom surface of the groove is higher than a bottom surface of the mounting portion 205. The groove is used for accommodating an extended pipeline of the vacuum cleaner module 10, or for grasping the mopping module 20 for independent operation.

In some embodiments, the vacuum cleaner module 10 and the mopping module 20 are engaged through connecting portions thereof. A connecting portion of the vacuum cleaner module 10 is an engagement groove, and a connecting portion of the mopping module 20 is an engagement protrusion. The engagement protrusion of the connecting portion of the mopping module 20 may be lifted by depressing the pedal linkage assembly of the mopping module 20 so as to lift the engagement protrusion away from the engagement groove of the connecting portion of the vacuum cleaner module 10, thereby releasing and disengaging the vacuum cleaner module 10.

The vacuum cleaner module has the functions of both sucking cleaning and mopping cleaning, the vacuum cleaner module 10 performs sucking cleaning, and the mopping module 20 performs mopping cleaning.

In some embodiments, the mopping cloth 18 of the mopping module 20 is in contact with the ground to be cleaned, there is a first distance between the bristle strip 204 of the mopping module 20 and the ground to be cleaned, there is a second distance between the roller 203 of the mopping module 20 and the ground to be cleaned, and there is a third distance between a bottom of the rolling brush 103 of the vacuum cleaner module 10 and the ground to be cleaned.

The third distance is greater than the first distance and the second distance, the second distance is greater than or equal to the first distance, and the first distance is greater than or equal to 0 mm.

The second distance is greater than the first distance by 0.5-1 mm.

The roller 203 is a retractable roller 203, which may adjust a range of the second distance, and the range which may be adjusted by the roller 203 is 0.5-1 mm.

Preferably, the second distance is greater than the first distance by 0.8 mm.

The third distance is 3-8 mm, and the first distance is 0-2 mm.

Preferably, the third distance is 4 or 5 mm, and the first distance is 1 mm.

In some embodiments, in actual use, the vacuum cleaner module travels on the ground to be cleaned by the mopping module 20 in a contact manner. There is a third distance between the bottom of the rolling brush 103 of the vacuum cleaner module 10 and the ground to be cleaned, and thus the airflow may suck the dust and debris on the ground to be cleaned into the chamber through the vacuum cleaner port 104 by the third distance between the rolling brush 103 and the ground to be cleaned. The debris and dust in the chamber are vacuum sucked into a dust drum for further processing. Meanwhile, the mopping cloth 18 of the mopping module 20 connected to the rear end of the vacuum cleaner module 10 further drags and absorbs electrostatic dust and small foam particles and other fine debris which are remained on the ground to be cleaned, so that the dust, large debris, small debris as well as fine debris and electrostatic dust on the ground may be effectively removed.

It should be noted that a bottom of the mopping module 20 is higher than the vacuum cleaner module 10. The bristle strip 204 is attached to the bottom of the mopping module 20, and is higher than the rolling brush 103 as a whole. Therefore, when the water in the water tank 1 passes through the mopping cloth 18 to clean the ground, the water overflowed on the ground may be prevented from being sucking into the dust drum through the rotation of the rolling brush 103. This height difference not only ensures that the vacuum cleaner module 10 absorbs the ground dust, but also ensures that the mopping module 20 cleans the ground by mopping the ground.

Furthermore, the bristle strip 204 of the mopping module 20 have a first distance from the ground to be cleaned, and the roller 203 of the mopping module 20 has a second distance from the ground to be cleaned. When the first distance is equal to 0 mm or slightly greater than 0 mm, since the mopping cloth 18 of the mopping module 20 may be compressed, the bristle strip 204 and the mopping cloth 18 are basically on the same horizontal plane, and at this point, the water overflowing from the mopping cloth 18 may be effectively blocked by the bristle strip 204, and thus is prevented from being sucking into the dust drum through the rotation of the roller brush 103.

Further, when the first distance is greater than 0 mm and less than 2 mm, also since the mopping cloth 18 of the mopping module 20 may be compressed, the bristle strip 204 will be inclined, and part of the bristle strip will be in contact with the ground to be cleaned, which can also effectively block the water overflowing from the mopping cloth 18. The setting of this distance may be beneficial to improve the redundancy of processing and assembling, to reduce the precision requirement for mold opening and processing of parts, and to save a production cost. And also, the bristle strip 204 is engaged in not full surface-contact manner. Due to the fact that the water overflowing from the mopping cloth 18 is effectively blocked, it is possible to reduce a driving resistance of the vacuum cleaner module on the ground to be cleaned, to improve a power consumption efficiency. Thus, a good sucking and mopping operation feel is obtained.

Meanwhile, the roller 203 is a retractable roller 203, and the roller 203 may adjust the range of the second distance. On the premise of ensuring the reliable support and guidance of the vacuum cleaner module, the first distance and the second distance are dynamically adjusted. Due to the change of a contact force between the roller 203 and the ground to be cleaned, a contact area and contact force between the bristle strip 204 and the ground to be cleaned are indirectly changed, so that the vacuum cleaner module may adapt to different grounds to be cleaned, which has a good technical effect of effectively preventing the water overflowing from the mopping cloth 18 from being sucked into the dust drum through the rotation of the rolling brush 103.

Other embodiments of the present disclosure will be easily conceived by those skilled in the art after taking the Description into consideration and practicing the invention disclosed herein. The present application is intended to cover any variations, uses, or adaptive changes of the present disclosure. These variations, uses, or adaptive changes follow the general principles of the present disclosure and include common general knowledge or conventional technical means in the art that are not disclosed in the present disclosure. The Description and the embodiments are to be regarded as being exemplary only. The true scope and spirit of the present disclosure are subject to the appended claims.

What is claimed is:

1. A mopping module, comprising:

a water tank, provided with a water tank hole at a bottom of the water tank, wherein the water tank hole communicates with an interior of the water tank;

a mopping cloth, provided outside the bottom of the water tank; and a water amount control mechanism, comprising a knob and a water control tray, configured to adjust an amount of water flowing from the water tank to the mopping cloth through the water tank hole by controlling cooperation of the water control tray and the water tank hole via the knob;

wherein the knob comprises a knob upper-cover, a knob screw, and a knob rod which are fixedly connected in sequence, and the knob upper-cover is provided on an upper surface of the water tank, the knob rod is rotatably penetrated into the water tank, the knob rod comprises a step-shaped columnar rod body with a smaller-diameter upper portion and a larger-diameter lower portion, and the water control tray is integrally provided outside a lower end of the knob rod.

2. The mopping module according to claim 1, wherein the water tank hole comprises at least two water tank holes of different sizes, the water control tray is provided with a water control hole therethrough, an area of the water control hole is larger than or equal to an area of any one of the at least two water tank holes, and the water control hole is controlled to communicate with one of the at least two water tank holes by rotating the water control tray.

3. The mopping module according to claim 1, wherein the water tank hole comprises one water tank hole, the water control tray is provided with a water control hole therethrough, and an overlapping area between the water tank hole and the water control hole is adjustable by rotating the water control tray.

4. The mopping module according to claim 1, wherein the mopping module further comprises:

a water tank bottom-cover, provided between the water tank and the mopping cloth, wherein a water passing channel is provided between the water tank bottom-cover and the water tank, a water outlet hole is provided on the water tank bottom-cover, the water tank hole communicates with the water outlet hole through the water passing channel, and the water outlet hole communicates with the mopping cloth.

5. The mopping module according to claim 4, wherein an outer lower surface of the water tank is partially recessed upwardly to form a water passing groove, the water passing channel is formed between the water tank bottom-cover and the water passing groove, the water control tray is located within the water passing channel, the water control tray is rotatable and upwardly and downwardly movable in the water passing channel, and water in the water tank is released to the mopping cloth through the water passing groove and the water outlet hole.

6. The mopping module according to claim 4, wherein when the mopping module is in a suspended state, the water outlet hole is higher than the water tank hole.

7. The mopping module according to claim 4, wherein an air inlet hole is provided on the water tank bottom-cover, and the mopping module further comprises:

an air inlet pipeline, fixedly provided within the water tank and communicated with the air inlet hole, wherein the air inlet pipeline extends from the air inlet hole to an upper portion of the water tank to supply air into the water tank; wherein, the mopping cloth covers the air inlet hole, a surface of the mopping cloth is spaced from the air inlet hole by a distance in a non-water-stop state, and the surface of the mopping cloth blocks the air inlet hole in a water-stop state;

an accommodating portion is provided at a position of an inner upper surface of the water tank corresponding to the air inlet pipeline, and an upper end portion of the air inlet pipeline extends into the accommodating portion in a non-contact manner; and an air outlet hole on the upper end portion of the air inlet pipeline is provided as an opening groove, and a depth of the opening groove is less than a depth of the accommodating portion; and the opening groove is cross-shaped, or is provided in a form of symmetrical notches, or is a saw teeth shape.

8. The mopping module according to claim 1, wherein an upper outer surface of the water tank is partially recessed downwardly to form a rotary accommodating groove, a side wall of the rotary accommodating groove is provided with a recessed portion, steel ball holes are symmetrically provided on both sides of the knob upper-cover, a knob steel ball spring and a knob steel ball are sequentially mounted in each of the steel ball holes from inside to outside, the knob upper-cover is embedded and mounted in the rotary accommodating groove, and the knob steel ball abuts against the recessed portion of the side wall of the rotary accommodating groove.

9. The mopping module according to claim 1, wherein an inner lower surface of the water tank is integrally provided with a water tank lower-bracket, a baffle ring is integrally provided in the water tank lower-bracket, the knob rod is sleeved with a button spring, and an upper end and a lower end of the button spring respectively abut against the knob upper-cover and the water tank lower-bracket.

10. The mopping module according to claim 9, wherein an inner hole of the baffle ring is smaller than an inner hole of the water tank lower-bracket, an upper end surface of the knob rod is provided with a threaded hole, an upper end of the knob rod passes through the inner hole of the baffle ring, and the knob screw is screwed with the threaded hole of the knob rod.

11. The mopping module according to claim 9, wherein a circular groove is provided under the knob upper-cover, the upper end of the button spring abuts against the circular groove, the lower end of the button spring abuts against the baffle ring, and the knob upper-cover and the knob rod move upwardly under an action of a restoring force of the button spring.

12. The mopping module according to claim 1, wherein the mopping module further comprises:

a mopping cloth cleaning mechanism, engaged to an accommodating groove of the water tank, wherein when the mopping cloth is to be cleaned, the mopping cloth cleaning mechanism disengages from the accommodating groove to scrape and clean the mopping cloth; wherein, the mopping cloth cleaning mechanism comprises a first plate body, a second plate body, a handle, a scraping blade, and a sliding leg; wherein, the first plate body and the second plate body form an L configuration; the handle is provided on the first plate body; the scraping blade is provided on the second plate body; the handle and the scraping blade are respectively located at distal ends of the L configuration; and the sliding leg is located on the second plate body; and a sliding chute is provided on the water tank, and the sliding leg is slidable in the sliding chute, thereby enabling the mopping cloth cleaning mechanism to slide along the sliding chute and enabling the scraping blade to scrape and clean the mopping cloth.

13. A cleaning head, comprising:

a mopping module, comprising:

a water tank, provided with at least one water tank hole at a bottom of the water tank, wherein the water tank hole communicates with an interior of the water tank;

a mopping cloth, provided outside the bottom of the water tank; and a water amount control mechanism, comprising a knob and a water control tray, configured to adjust an amount of water flowing from the water tank to the mopping cloth through the water tank hole by controlling cooperation of the water control tray and the water tank hole via the knob, wherein the knob comprises a knob upper-cover, a knob screw, and a knob rod which are fixedly connected in sequence, and the knob upper-cover is provided on an upper surface of the water tank, the knob rod is rotatably penetrated into the water tank, the knob rod comprises a step-shaped columnar rod body with a smaller-diameter upper portion and a larger-diameter lower portion, and the water control tray is integrally provided outside a lower end of the knob rod; and a vacuum cleaner module, detachably engaged with the mopping module;

wherein the vacuum cleaner module is engaged with the mopping module through a mounting portion provided on the mopping module, a bottom surface of the mopping module is in contact with a ground to be cleaned, and a bottom surface of the vacuum cleaner module is separated from the ground to be cleaned.

14. The cleaning head according to claim 13, wherein a supporting plate extends from a front end of a bottom case of a housing of the water tank outwardly and integrally, and a supporting member is provided at a bottom of the supporting plate; wherein, a height of the supporting member is less than a maximum thickness of the mopping cloth and greater than a minimum thickness of the mopping cloth.

15. The cleaning head according to claim 14, wherein the supporting member comprises:

a bristle strip protruding from the bottom of the supporting plate, configured to provide a support when the vacuum cleaner module is placed on the ground to be cleaned; or one or more rollers, supporting the vacuum cleaner module to be off the ground to be cleaned.

16. The cleaning head according to claim 14, wherein the mopping cloth is in contact with the ground to be cleaned, there is a first distance between the supporting member and the ground to be cleaned, there is a second distance between the bottom surface of the vacuum cleaner module and the ground to be cleaned, and the second distance is greater than the first distance.

17. The cleaning head according to claim 14, wherein the mounting portion comprises a locking shaft, a linkage portion and a locking portion, wherein, the locking portion is provided at one end of the mounting portion and moves between a first state and a second state, the linkage portion is provided at another end of the mounting portion, and configured to move the locking portion from the first state to the second state, in the first state the locking portion locks the vacuum cleaner module, and in the second state the locking portion rotates around the locking shaft so as to unlock the vacuum cleaner module.

18. The cleaning head according to claim 17, wherein a first reset device is further provided on the mounting portion, and the first reset device resets the locking portion from the second state to the first state.

19. The cleaning head according to claim 17, wherein the vacuum cleaner module further comprises:

a pedal, provided on an upper surface of the water tank, wherein the pedal is provided with a pedal inner protrusion that interacts with the linkage portion, the pedal inner protrusion is configured to drive the linkage portion to move with movement of the pedal, thereby moving the locking portion from the first state to the second state;

wherein, the pedal is provided with a rotating shaft and a second reset device, the pedal is configured to move from a third state to a fourth state when depressed, and the second reset device is configured to reset the pedal from the fourth state to the third state; the third state corresponds to the first state, and the fourth state corresponds to the second state.

* * * * *